US008104859B2

(12) United States Patent
Katoh

(10) Patent No.: US 8,104,859 B2
(45) Date of Patent: Jan. 31, 2012

(54) HEAD ARRAY UNIT AND IMAGE FORMING APPARATUS

(75) Inventor: Tomomi Katoh, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 760 days.

(21) Appl. No.: 12/191,039

(22) Filed: Aug. 13, 2008

(65) Prior Publication Data

US 2009/0051724 A1 Feb. 26, 2009

(30) Foreign Application Priority Data

Aug. 22, 2007 (JP) ..... 2007-216353

(51) Int. Cl.
*B41J 29/377* (2006.01)

(52) U.S. Cl. ..... 347/18

(58) Field of Classification Search ..... 347/18
See application file for complete search history.

(56) References Cited

U.S. PATENT DOCUMENTS

| | | | |
|---|---|---|---|
| 6,074,035 | A | 6/2000 | Irizawa et al. |
| 6,682,185 | B2 | 1/2004 | Hashimoto et al. |
| 6,913,348 | B2 | 7/2005 | Hashimoto et al. |
| 7,325,908 | B2 | 2/2008 | Katoh et al. |
| 7,364,253 | B2 | 4/2008 | Hashimoto et al. |
| 2002/0057312 | A1 | 5/2002 | Watanabe et al. |
| 2006/0139419 | A1 | 6/2006 | Shigemura |
| 2007/0008356 | A1 | 1/2007 | Katoh |
| 2008/0158294 | A1 | 7/2008 | Katoh |

FOREIGN PATENT DOCUMENTS

| | | | |
|---|---|---|---|
| EP | 0736390 | A2 | 10/1996 |
| EP | 0870622 | A1 | 10/1998 |
| JP | 8-276574 | | 10/1996 |
| JP | 8-276575 | | 10/1996 |
| JP | 10-278251 | | 10/1998 |
| JP | 3327726 | | 7/2002 |
| JP | 2004-160952 | | 6/2004 |
| JP | 2006-181949 | | 7/2006 |
| JP | 2007-320186 | | 12/2007 |

OTHER PUBLICATIONS

Nov. 19, 2008 search report in connection with a counterpart European patent application No. 08 25 2639.
Oct. 18, 2011 Japanese official action in connection with a counterpart Japanese patent application.

*Primary Examiner* — Omar Rojas
(74) *Attorney, Agent, or Firm* — Cooper & Dunham LLP

(57) ABSTRACT

A head array unit includes a plurality of liquid discharging heads configured to discharge liquid and a head supporter configured to support the plurality of liquid discharging heads. The head supporter includes a plurality of liquid inlets, a channel system, and at least two ports. The plurality of liquid inlets is configured to supply liquid to the plurality of liquid discharging heads, respectively. The channel system is configured to sandwich or surround each of the plurality of liquid inlets and contain coolant to control a temperature of the head array unit. The at least two ports are connected to the channel system.

17 Claims, 16 Drawing Sheets

HEAD ARRAY UNIT AND IMAGE FORMING APPARATUS

BACKGROUND

1. Technical Field

The present specification describes a head array unit and an image forming apparatus, and more particularly, a head array unit and an image forming apparatus including the head array unit for discharging liquid stably.

2. Discussion of the Background

An image forming apparatus, such as a copier, a printer, a facsimile machine, a plotter, or a multifunction printer having at least one of copying, printing, scanning, and facsimile functions, typically forms an image on a recording medium (e.g., a sheet) by a liquid discharging method. Thus, for example, a liquid discharging head discharges liquid (e.g., an ink drop) onto a conveyed sheet, and the liquid is then adhered to the sheet to form an image on the sheet.

Currently, there is market demand for an image forming apparatus capable of forming images at high speed. To accommodate such demand, the image forming apparatus may include more liquid discharging heads or nozzles or may increase a liquid discharging frequency. For example, a plurality of short liquid discharging heads may be combined into a long head array unit, so that the head array unit need not move in a main scanning direction to discharge an ink drop onto a sheet conveyed in a sub-scanning direction.

However, when the image forming apparatus includes many nozzles or drives the liquid discharging head at a higher frequency, a temperature of the liquid discharging head increases and thereby a temperature of ink contained in the liquid discharging head also increases, resulting in a change in ink viscosity. Consequently, the changed ink viscosity affects liquid discharging property of the liquid discharging head.

To address this problem, one example of a related art image forming apparatus controls an ink discharging signal based on the temperature of the liquid discharging head. However, when the liquid discharging head including many nozzles is driven at a higher frequency, the temperature of the liquid discharging head increases sharply, and thereby the image forming apparatus cannot adequately control the temperature of the liquid discharging head by controlling only the ink discharging signal.

To address this problem, another example of a related art image forming apparatus includes a head array unit in which a liquid channel is provided inside a head supporter for holding a base of the liquid discharging head. The liquid channel is provided separately from a shared liquid chamber containing ink to be discharged. Coolant flows in the liquid channel to maintain the temperature of the liquid discharging head at a constant level. However, coolant flows in the liquid channel provided in both ends of the base of the liquid discharging head only, and therefore does not cool a center of the base of the liquid discharging head, which easily stores heat, effectively.

Obviously, such insufficient cooling of the liquid discharging head is undesirable, and accordingly, there is a need for a technology to effectively suppress temperature increase of the liquid discharging head to maintain stable liquid discharging performance.

BRIEF SUMMARY

In an aspect of this patent specification, a novel head array unit includes a plurality of liquid discharging heads configured to discharge liquid and a head supporter configured to support the plurality of liquid discharging heads. The head supporter includes a plurality of liquid inlets, a channel system, and at least two ports. The plurality of liquid inlets is configured to supply liquid to the plurality of liquid discharging heads, respectively. The channel system is configured to sandwich each of the plurality of liquid inlets and contain coolant to control a temperature of the head array unit. The at least two ports are connected to the channel system.

In another aspect of this patent specification, a novel head array unit includes a plurality of liquid discharging heads configured to discharge liquid and a head supporter configured to support the plurality of liquid discharging heads. The head supporter includes a plurality of liquid inlets, a channel system, and at least two ports. The plurality of liquid inlets is configured to supply liquid to the plurality of liquid discharging heads, respectively. The channel system is configured to surround each of the plurality of liquid inlets and contain coolant to control a temperature of the head array unit. The at least two ports are connected to the channel system.

This patent specification further describes a novel image forming apparatus. One example of a novel image forming apparatus includes a head array unit including a plurality of liquid discharging heads configured to discharge liquid and a head supporter configured to support the plurality of liquid discharging heads. The head supporter includes a plurality of liquid inlets, a channel system, and at least two ports. The plurality of liquid inlets is configured to supply liquid to the plurality of liquid discharging heads, respectively. The channel system is configured to sandwich each of the plurality of liquid inlets and contain coolant to control a temperature of the head array unit. The at least two ports are connected to the channel system.

BRIEF DESCRIPTION OF THE DRAWINGS

A more complete appreciation of the aforementioned and other aspects, features and advantages would be better understood by reference to the following detailed description when considered in connection with the accompanying drawings, wherein.

DETAILED DESCRIPTION OF THE EXEMPLARY EMBODIMENTS

Figure 1:
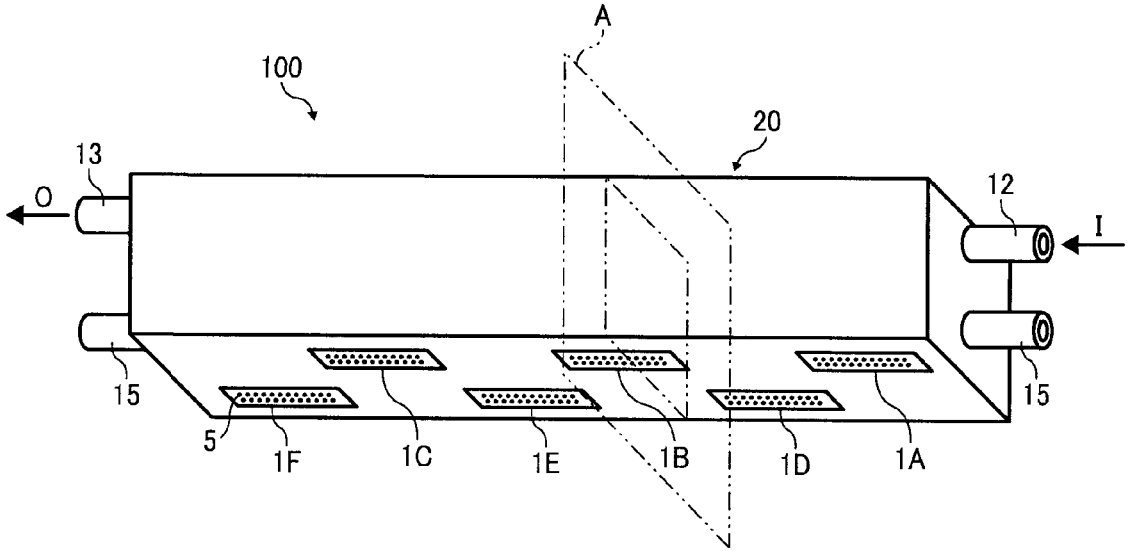
FIG. 1 is a perspective view of a head array unit according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIGS. 1 to 6, a head array unit 100 according to an exemplary embodiment is explained.

Figure 2:
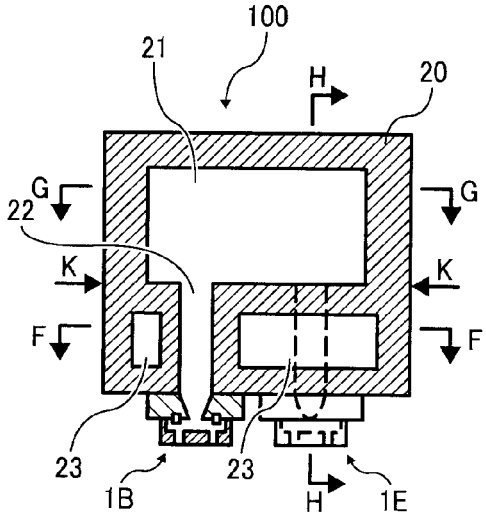
FIG. 2 is a sectional view of the head array unit shown in FIG. 1 taken on virtual section A in FIG. 1.
Figure 3:
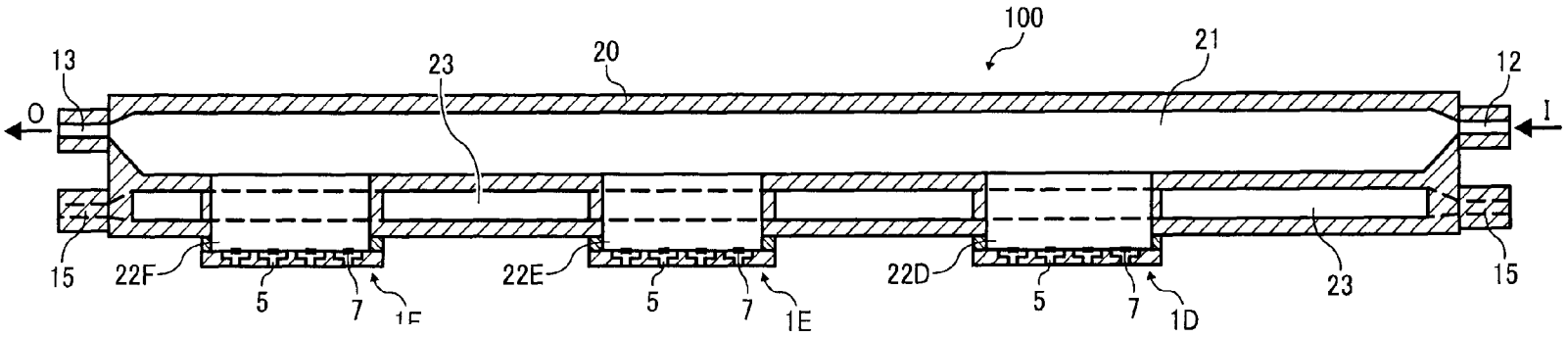
FIG. 3 is a sectional view of the head array unit shown in FIG. 2 taken on line H-H in FIG. 2.
Figure 4:
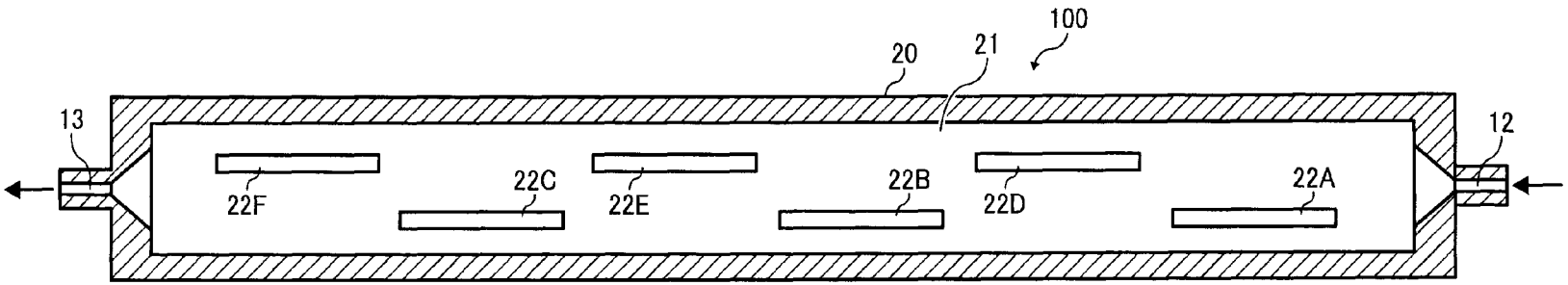
FIG. 4 is a sectional view of the head array unit shown in FIG. 2 taken on line G-G in FIG. 2.
Figure 5:
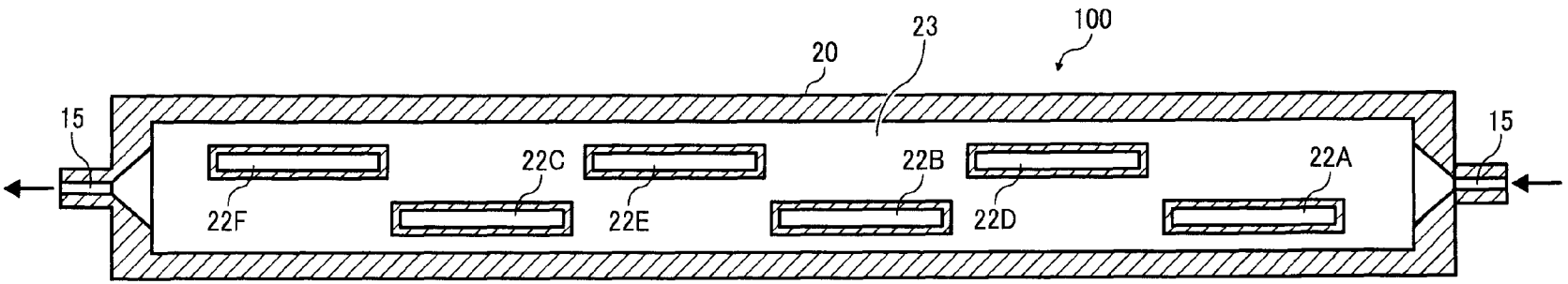
FIG. 5 is a sectional view of the head array unit shown in FIG. 2 taken on line F-F in FIG. 2.

FIG. 1 is a perspective view of the head array unit 100. FIG. 2 is a sectional view of the head array unit 100 taken on virtual section A in FIG. 1. FIG. 3 is a sectional view of the head array unit 100 taken on line H-H in FIG. 2. FIG. 4 is a sectional view of the head array unit 100 taken on line G-G in FIG. 2. FIG. 5 is a sectional view of the head array unit 100 taken on line F-F in FIG. 2.

As illustrated in FIG. 1, the head array unit 100 includes liquid discharging heads 1A, 1B, 1C, 1D, 1E, and 1F and a head supporter 20. Each of the liquid discharging heads 1A, 1B, 1C, 1D, 1E, and 1F includes a nozzle 5. The head supporter 20 includes an inlet port 12, an outlet port 13, and coolant ports 15. As illustrated in FIG. 2, the head supporter 20 further includes a liquid channel 21, a liquid inlet 22, and a coolant channel 23. As illustrated in FIG. 3, each of the liquid discharging heads 1D, 1E, and 1F includes a shared liquid chamber 7.

Each of the liquid discharging heads 1A, 1B, 1C, 1D, 1E, and 1F (depicted in FIG. 1) is hereinafter referred to as the liquid discharging head 1 when the liquid discharging heads 1A, 1B, 1C, 1D, 1E, and 1F are not distinguished from each other.

Figure 6:
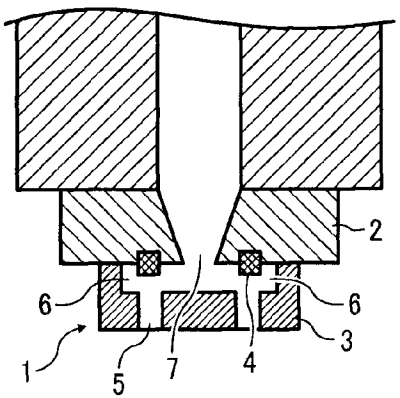
FIG. 6 is a partially enlarged view of a liquid discharging head included in the head array unit shown in FIG. 1.

FIG. 6 is a partially enlarged view of the liquid discharging head 1. The liquid discharging head 1 includes a heat generating base 2, a flow route base 3, a heat generating element 4, and an individual liquid chamber 6.

As illustrated in FIG. 1, the head array unit 100 includes a plurality of short liquid discharging heads 1A, 1B, 1C, 1D, 1E, and 1F. According to this exemplary embodiment, the head array unit 100 includes six liquid discharging heads 1A, 1B, 1C, 1D, 1E, and 1F. Alternatively, the head array unit 100 may include other number of liquid discharging heads 1. The liquid discharging heads 1A, 1B, 1C, 1D, 1E, and 1F are arranged along a longitudinal direction of the liquid discharging heads 1A, 1B, 1C, 1D, 1E, and 1F in such a manner that the adjacent liquid discharging heads 1A, 1B, 1C, 1D, 1E, and 1F are shifted from each other in a direction perpendicular to the longitudinal direction of the liquid discharging heads 1A, 1B, 1C, 1D, 1E, and 1F. Namely, the liquid discharging heads 1A, 1B, 1C, 1D, 1E, and 1F are staggered on the head supporter 20. The liquid discharging heads 1A, 1B, 1C, 1D, 1E, and 1F form a long line-type head.

As illustrated in FIG. 6, the liquid discharging head 1 is a thermal-type head. A plurality of nozzles 5 for discharging a liquid drop (e.g., an ink drop) and a plurality of individual liquid chambers 6 connected to the nozzles 5, respectively, are provided on the flow route base 3. A plurality of heat generating elements 4 corresponding to the plurality of individual liquid chambers 6, respectively, is provided on the heat generating base 2. A current carrier (not shown, e.g., FPC) is connected to the heat generating base 2. When a pulse voltage is input to the heat generating element 4 via the current carrier, the heat generating element 4 is driven and film boiling generates in liquid (e.g., ink) in the individual liquid chamber 6. Accordingly, a liquid drop (e.g., an ink drop) is discharged from the nozzle 5. According to this exemplary embodiment, the plurality of nozzles 5 is aligned in the longitudinal direction of the liquid discharging head 1 to form two rows of nozzles 5. The shared liquid chamber 7 is provided in a center of the heat generating base 2, and supplies liquid to the individual liquid chambers 6 connected to the nozzles 5.

The liquid discharging head 1 uses a side shooter method in which a direction of liquid (e.g., ink) flowing to a discharge energy acting portion (e.g., a heat generator) in the individual liquid chamber 6 is perpendicular to a center axis of an opening of the nozzle 5. The side shooter method may effectively convert energy generated by the heat generating element 4 into energy for forming a liquid drop and shooting the liquid drop. Further, the side shooter method may quickly recover meniscus by supplying liquid and thereby may provide high-speed driving.

An opening provided in the heat generating base 2 forms the shared liquid chamber 7. As illustrated in FIG. 3, the head supporter 20 is connected to the openings forming the shared liquid chambers 7 of the six liquid discharging heads 1A, 1B, 1C, 1D, 1E, and 1F, so that the head supporter 20 serves as a liquid supplier for supplying liquid to the shared liquid chamber 7. According to this exemplary embodiment, the liquid discharging heads 1A, 1B, 1C, 1D, 1E, and 1F are directly attached to the head supporter 20. Alternatively, other member, such as a spacer plate, may be provided between the liquid discharging heads 1A, 1B, 1C, 1D, 1E, and 1F and the head supporter 20.

As illustrated in FIG. 2, the liquid channel 21 is provided in the head supporter 20, and supplies liquid to the six liquid discharging heads 1A, 1B, 1C, 1D, 1E, and 1F. The liquid inlet 22 is connected to the liquid channel 21. As illustrated in FIG. 3, the inlet port 12 is provided at one end of the liquid channel 21 in a longitudinal direction of the liquid channel 21. The outlet port 13 is provided at another end of the liquid channel 21 in the longitudinal direction of the liquid channel 21. Liquid enters the liquid channel 21 through the inlet port 12 and goes out of the liquid channel 21 through the outlet port 13. Liquid enters the shared liquid chambers 7 of the liquid discharging heads 1A, 1B, 1C, 1D, 1E, and 1F from the liquid channel 21 through the liquid inlets 22A, 22B, 22C, 22D, 22E, and 22F, respectively.

The head supporter 20 is provided in a liquid supply route (not shown). Liquid flows from the inlet port 12 toward the outlet port 13 in the liquid channel 21 provided in the head supporter 20 to circulate in the liquid supply route. For example, liquid flows into the inlet port 12 in a direction I and flows out of the outlet port 13 in a direction O.

As illustrated in FIG. 2, the coolant channel 23 is provided in the head supporter 20 and contains coolant flowing to adjust a temperature of the head array unit 100. As illustrated in FIG. 3, the coolant ports 15 are provided on both ends of the head supporter 20 in a longitudinal direction of the head supporter 20, and connected to the coolant channel 23.

As illustrated in FIG. 2, the coolant channel 23 surrounds or sandwiches the liquid inlet 22. The coolant enters and goes out of the coolant channel 23 through the coolant ports 15 (depicted in FIG. 3). Further, as described above, the coolant channel 23 is provided between the liquid channel 21 and the liquid discharging head 1. Accordingly, the coolant channel 23 may effectively adjust a temperature of liquid in the liquid channel 21 and a temperature of the liquid discharging head 1 to a desired temperature. Therefore, even when the thermal-type liquid discharging head 1 is driven at a high frequency, the liquid discharging head 1 may stably discharge a liquid drop without storing heat.

As illustrated in FIG. 1, in the head array unit 100, the plurality of liquid discharging heads 1A, 1B, 1C, 1D, 1E, and 1F for discharging a liquid drop is arranged (e.g., staggered) on the head supporter 20. The head supporter 20 includes the liquid inlet 22 (depicted in FIG. 2), the coolant channel 23 (depicted in FIG. 2), and at least two coolant ports 15. The liquid inlet 22 supplies liquid to the liquid discharging head 1. The coolant channel 23 surrounds the liquid inlet 22. Coolant flows in the coolant channel 23 to control the temperature of the head array unit 100. At least two coolant ports 15 are connected to the coolant channel 23. Thus, the head array unit 100 may effectively suppress temperature increase and may maintain stable liquid discharging performance.

Figure 7:
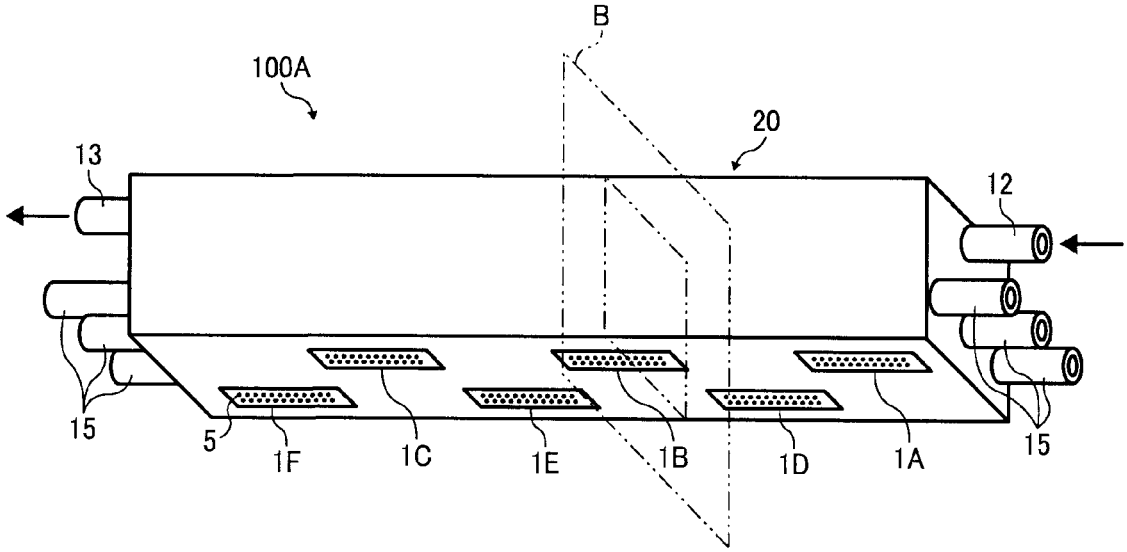
FIG. 7 is a perspective view of a head array unit according to another exemplary embodiment.
Figure 8:
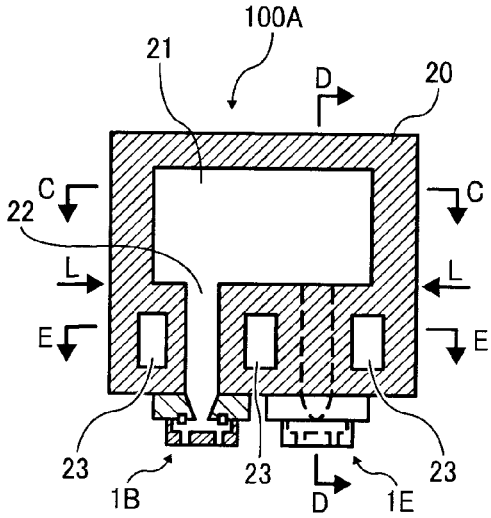
FIG. 8 is a sectional view of the head array unit shown in FIG. 7 taken on virtual section B in FIG. 7.
Figure 9:
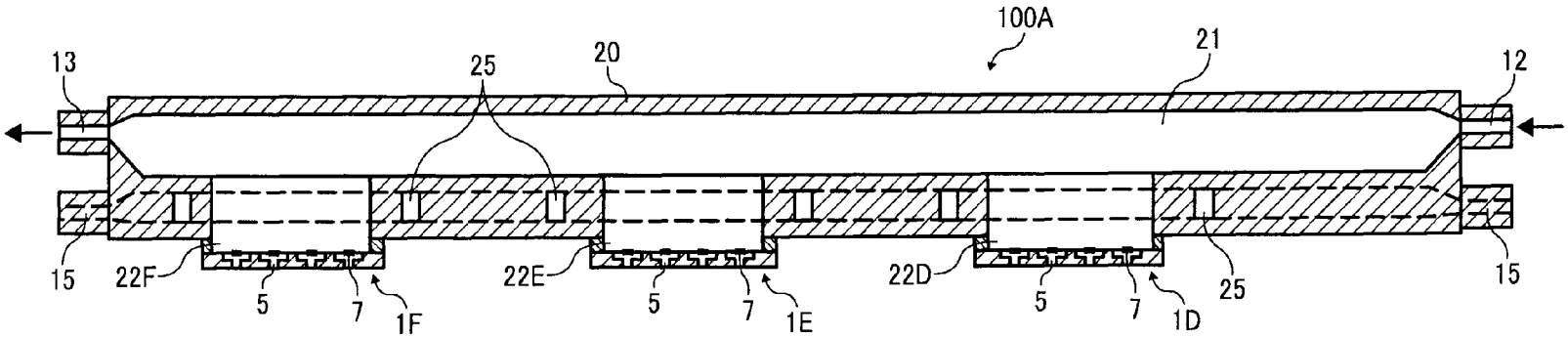
FIG. 9 is a sectional view of the head array unit shown in FIG. 8 taken on line D-D in FIG. 8.
Figure 10:
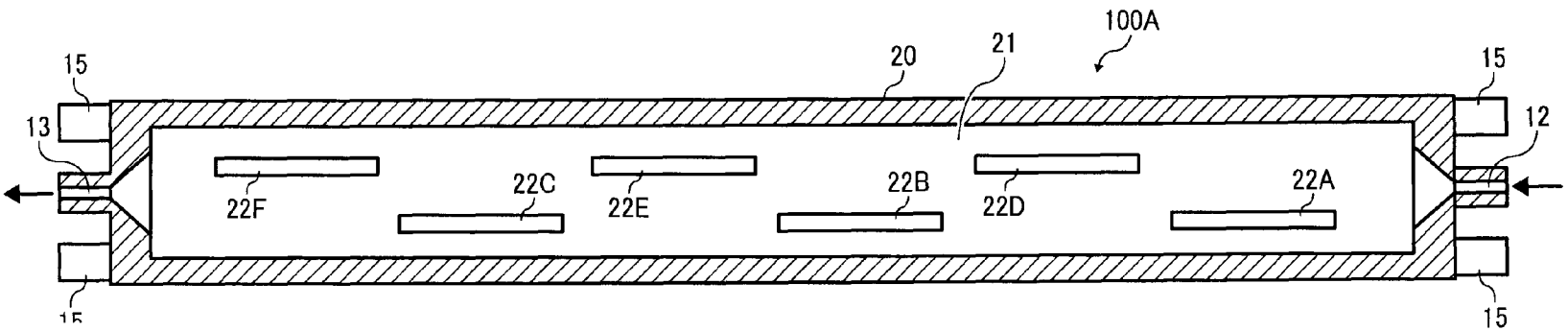
FIG. 10 is a sectional view of the head array unit shown in FIG. 8 taken on line C-C in FIG. 8.
Figure 11:
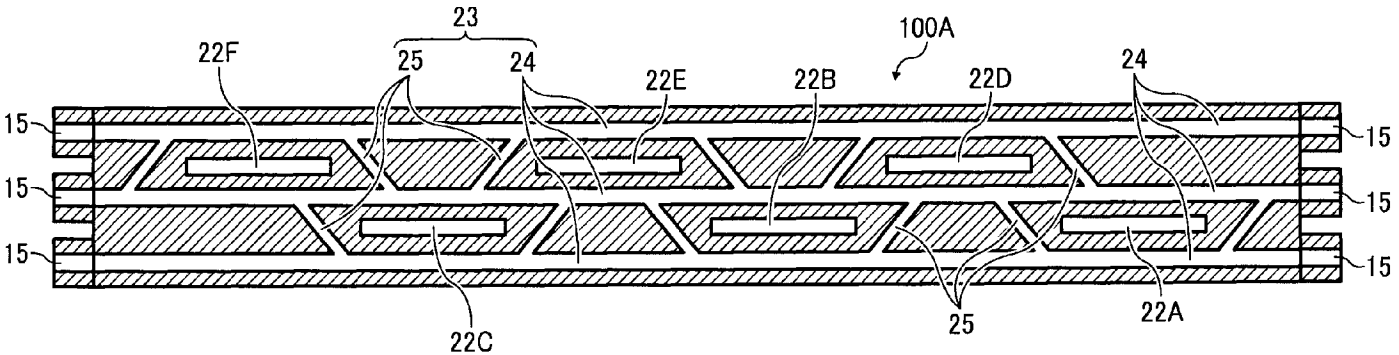
FIG. 11 is a sectional view of the head array unit shown in FIG. 8 taken on line E-E in FIG. 8.

Referring to FIGS. 7 to 11, the following describes a head array unit 100A according to another exemplary embodiment. FIG. 7 is a perspective view of the head array unit 100A. FIG. 8 is a sectional view of the head array unit 100A taken on virtual section B in FIG. 7. FIG. 9 is a sectional view of the head array unit 100A taken on line D-D in FIG. 8. FIG. 10 is a sectional view of the head array unit 100A taken on line C-C in FIG. 8. FIG. 11 is a sectional view of the head array unit 100A taken on line E-E in FIG. 8.

As illustrated in FIG. 7, the head array unit 100A includes six coolant ports 15. As illustrated in FIG. 9, the head array unit 100A further includes a sub channel 25. As illustrated in FIG. 11, the head array unit 100A further includes a main channel 24. The other elements of the head array unit 100A are common to the head array unit 100 depicted in FIG. 1.

As illustrated in FIG. 7, three coolant ports 15 are provided on one end of the head supporter 20 and another three coolant ports 15 are provided on another end of the head supporter 20. The six coolant ports 15 are connected to the coolant channel 23 (depicted in FIG. 8).

As illustrated in FIG. 11, the main channel 24 and the sub channel 25 are included in the coolant channel 23. The main channel 24 has a tubular shape and straight connects the coolant port 15 provided on one end of the head supporter 20 (depicted in FIG. 7) to the coolant port 15 provided on another end of the head supporter 20. The sub channel 25 connects the main channels 24 to each other. For example, as illustrated in FIG. 9, at least two sub channels 25 are provided between the adjacent liquid discharging heads 1 in a longitudinal direction of the head array unit 100A. As illustrated in FIG. 11, one end of the sub channel 25 intersects one of the main channels 24 at an acute angle and another end of the sub channel 25 intersects other one of the main channels 24 at an obtuse angle.

The coolant channel 23 including the main channel 24 and the sub channel 25 surrounds the liquid inlet 22 (e.g., the liquid inlets 22A, 22B, 22C, 22D, 22E, and 22F). Coolant flows into and flows out of the coolant channel 23 through the coolant ports 15.

As illustrated in FIG. 8, the coolant channel 23 is provided between the liquid channel 21 and the liquid discharging head 1. Accordingly, the coolant channel 23 may effectively adjust the temperature of liquid in the liquid channel 21 and the temperature of the liquid discharging head 1 to a desired temperature.

As illustrated in FIG. 11, according to this exemplary embodiment, the coolant channel 23 is formed of the main channel 24 and the sub channel 25. Therefore, the coolant channel 23 has an increased surface area for heat exchange, providing effective temperature control. Further, coolant may flow in the coolant channel 23 at an increased speed. Thus, even when the thermal-type liquid discharging head 1 (depicted in FIG. 8) is driven at a high frequency, the liquid discharging head 1 may stably discharge a liquid drop without storing heat.

As illustrated in FIG. 8, the coolant channel 23 (e.g., the main channel 24 and the sub channel 25) has a rectangular shape in cross-section. Alternatively, the coolant channel 23 may have a trapezoidal shape in which a bottom provided near the liquid discharging head 1 is longer than a top provided near the liquid channel 21 to provide improved heat exchange efficiency.

The coolant channel 23 may preferably include a material having an increased thermal conductivity. For example, when the coolant channel 23 includes metal having a large thermal conductivity coefficient, the coolant channel 23 may effectively draw heat generated by the liquid discharging head 1 to prevent the liquid discharging head 1 from storing heat.

When the coolant channel 23 includes metal foam (e.g., SUS) having a diameter of about 600 μm and a porosity of about 95 percent, the coolant channel 23 may preferably have an increased surface area for contacting coolant. A material having a large thermal conductivity includes a resin filled with thermal conductivity filler, such as silica, alumina, boron nitride, magnesia, aluminum nitride, and silicon nitride. When the coolant channel 23 includes the resin, the coolant channel 23 may be integrally molded with the coolant ports 15 (depicted in FIG. 7) and the liquid channel 21, improving productivity. Alternatively, a portion of the head supporter 20 to which the liquid discharging head 1 is fixed and a portion of the head supporter 20 forming the coolant channel 23 may include a material having a high thermal conductivity, such as metal, and the liquid channel 21 may be molded with a low-cost-resin, so that the liquid channel 21 formed of the resin is layered on the coolant channel 23 formed of the metal.

Figure 12:
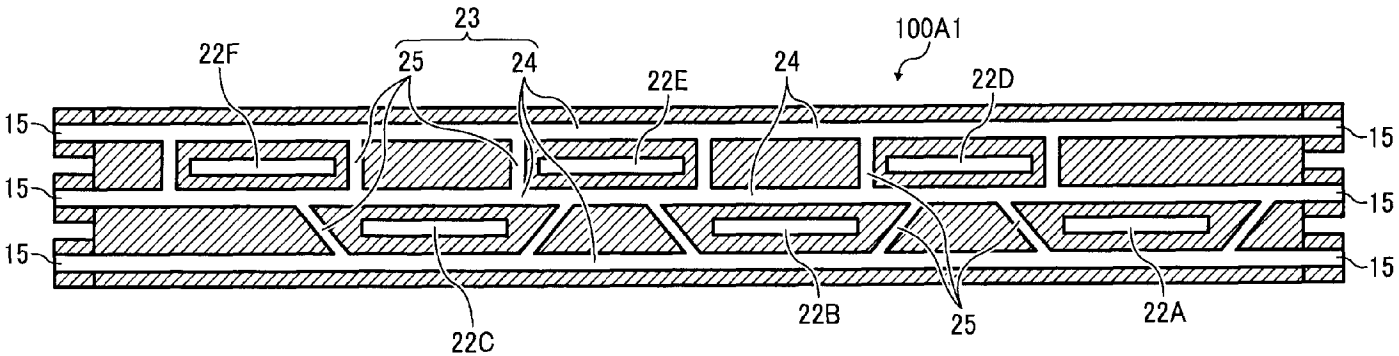
FIG. 12 is a sectional plane view of a head array unit as a modification example of the head array unit shown in FIG. 11.

FIG. 12 is a sectional view of a head array unit 100A1 as a modification example of the head array unit 100A depicted in FIG. 11. In the head array unit 100A1, the main channel 24 intersects the sub channel 25 at a right angle. Namely, the sub channel 25 extends in a direction perpendicular to a direction in which the main channel 24 extends. When the sub channel 25 extends obliquely with respect to the main channel 24, as illustrated in FIG. 11, coolant may branch or join smoothly at an intersection of the main channel 24 and the sub channel 25. In the head array unit 100A illustrated in FIG. 11, the sub channel 25 has a straight shape and the whole sub channel 25 extends obliquely with respect to the main channel 24. Alternatively, a part of the sub channel 25 near the intersection with the main channel 24 may, extend obliquely with respect to the main channel 24. Yet alternatively, the sub channel 25 may have a curved shape to form a smooth curve to intersect with the main channel 24.

Figure 13:
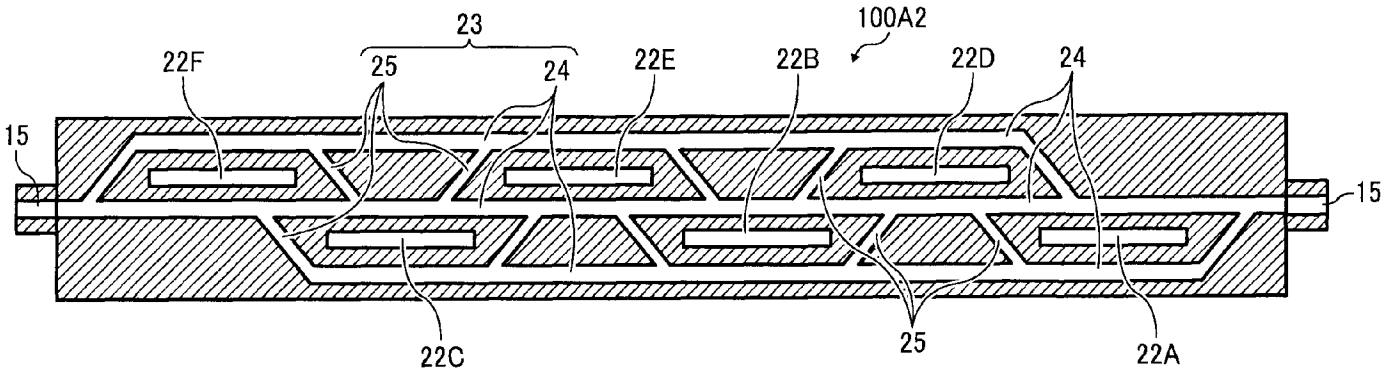
FIG. 13 is a sectional plane view of a head array unit using an A method according to yet another exemplary embodiment.
Figure 14:
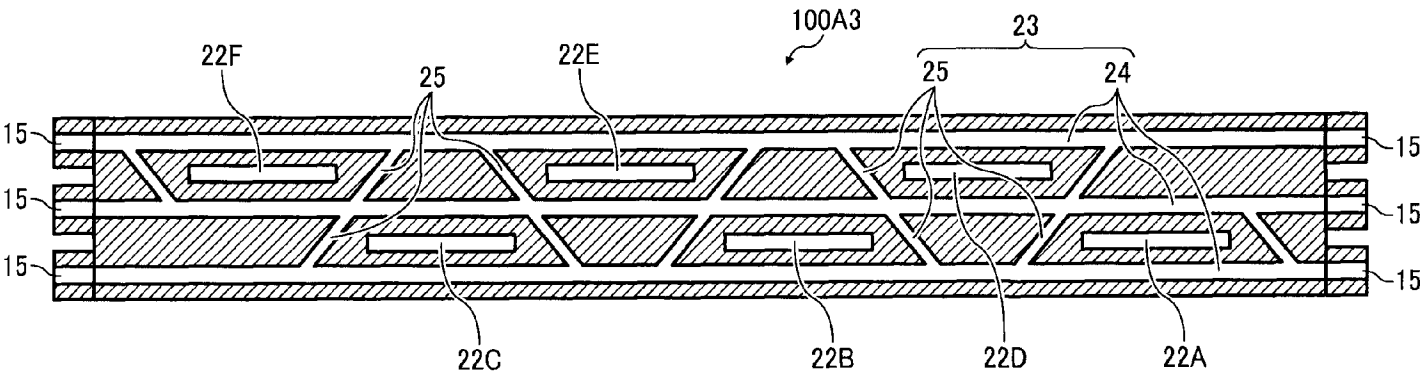
FIG. 14 is a sectional plane view of a head array unit using a B method or a C method according to yet another exemplary embodiment.
Figure 15:
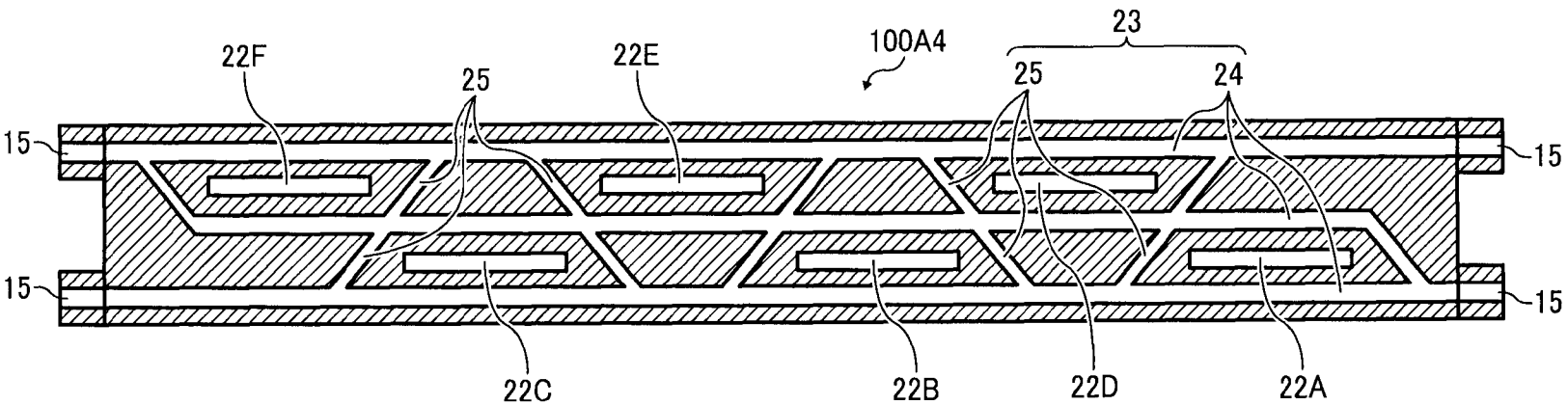
FIG. 15 is a sectional plane view of a head array unit using a D method according to yet another exemplary embodiment.
Figure 16A:
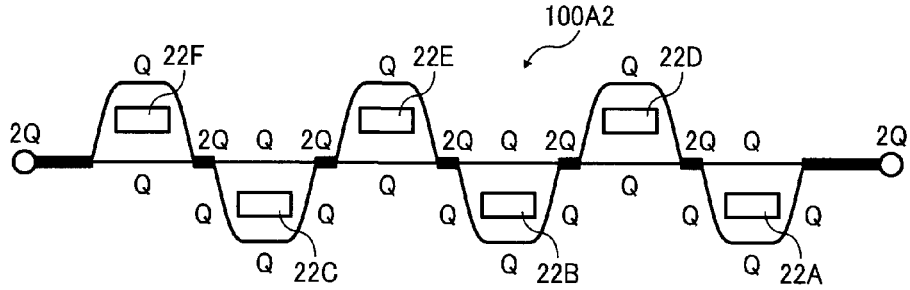
FIG. 16A is an illustration of the head array unit using the A method shown in FIG. 13 for explaining a flow rate of coolant when the head array unit includes a short liquid inlet.
Figure 16B:
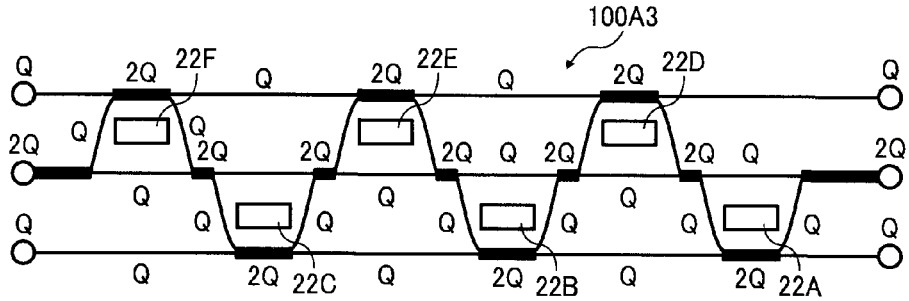
FIG. 16B is an illustration of the head array unit using the B method shown in FIG. 14 for explaining a flow rate of coolant when the head array unit includes a short liquid inlet.
Figure 16C:
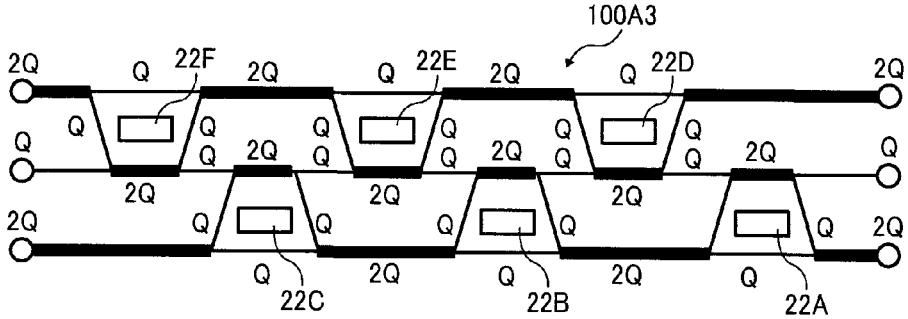
FIG. 16C is an illustration of the head array unit using the C method shown in FIG. 14 for explaining a flow rate of coolant when the head array unit includes a short liquid inlet.
Figure 16D:
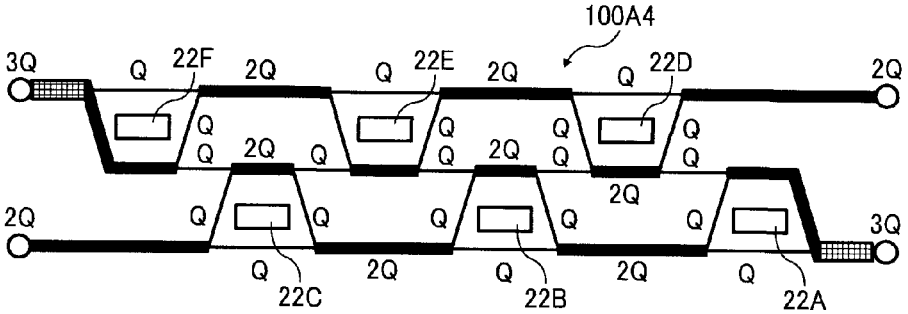
FIG. 16D is an illustration of the head array unit using the D method shown in FIG. 15 for explaining a flow rate of coolant when the head array unit includes a short liquid inlet.

Referring to FIGS. 13 to 15, the following describes modification examples of the coolant port 15, the main channel 24, and the sub channel 25.

FIG. 13 is a sectional view of a head array unit 100A2 using an A method according to yet another exemplary embodiment. In the head array unit 100A2, one coolant port 15 is provided on one end of the head array unit 100A2 and another coolant port 15 is provided on another end of the head array unit 100A2 in a longitudinal direction of the head array unit 100A2.

FIG. 14 is a sectional view of a head array unit 100A3 using a B method or a C method according to yet another exemplary embodiment. In the head array unit 100A3, three coolant ports 15 are provided on one end of the head array unit 100A3 and another three coolant ports 15 are provided on another end of the head array unit 100A3 in a longitudinal direction of the head array unit 100A3.

FIG. 15 is a sectional view of a head array unit 100A4 using a D method according to yet another exemplary embodiment. In the head array unit 100A4, two coolant ports 15 are provided on one end of the head array unit 100A4 and another two coolant ports 15 are provided on another end of the head array unit 100A4 in a longitudinal direction of the head array unit 100A4.

Various arrangements of the coolant ports 15, the main channel 24, and the sub channel 25 are possible as illustrated in FIGS. 1 to 15. In any arrangement, it is important that coolant flows uniformly in the whole flowable area without concentrating or stagnating in a part of the coolant channel 23. Therefore, a diameter of the main channel 24 and the sub channel 25 may be preferably set according to a state of coolant branching and joining so as to balance an amount of coolant flowing in the coolant channel 23.

Referring to FIGS. 16A, 16B, 16C, 16D, 17A, 17B, 17C, and 17D, the following describes a flow rate of coolant flowing in a flow portion (e.g., the coolant channel 23 and the coolant ports 15 depicted in FIGS. 13 to 15) of the head array unit 100A2 (depicted in FIG. 13), 100A3 (depicted in FIG. 14), and 100A4 (depicted in FIG. 15) in which the liquid discharging heads 1 (depicted in FIG. 1) are staggered in two rows. In FIGS. 16A, 16B, 16C, 16D, 17A, 17B, 17C, and 17D, flow amounts Q, 2Q, and 3Q indicate a flow amount in the flow portion. The flow amount 2Q indicates twice of the flow amount Q and the flow amount 3Q indicates three times of the flow amount Q.

When the head array units 100A2, 100A3, and 100A4 include small liquid inlets 22A, 22B, 22C, 22D, 22E, and 22F, the coolant ports 15, the main channel 24, and the sub channel 25 (depicted in FIGS. 13 to 15) may be arranged to provide a flow rate (e.g., the flow amounts Q, Q2, and Q3) illustrated in FIGS. 16A, 16B, 16C, and 16D. Accordingly, coolant may uniformly flow in the whole coolant channel 23. A flow rate between the coolant ports 15 may be adjusted by changing a diameter of the coolant ports 15 or by changing an output of pumps connected to the coolant ports 15, respectively.

As illustrated in FIGS. 17A, 17B, 17C, and 17D, when the head array units 100A2, 100A3, and 100A4 include large or long liquid inlets 22A, 22B, 22C, 22D, 22E, and 22F, the liquid inlets 22 adjacent to each other in a width direction (e.g., a short direction) of the head array unit 100A2, 100A3, or 100A4 partially overlap each other in a longitudinal direction of the head array unit 100A2, 100A3, or 100A4. In this case, the coolant ports 15, the main channel 24, and the sub channel 25 (depicted in FIGS. 13 to 15) may be arranged to provide a flow rate (e.g., the flow amounts Q, Q2, and Q3) illustrated in FIGS. 17A, 17B, 17C, and 17D.

Figure 17A:
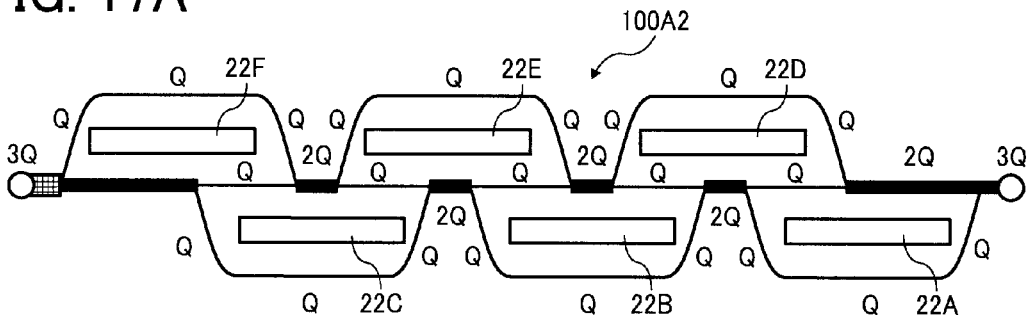
FIG. 17A is an illustration of the head array unit using the A method shown in FIG. 13 for explaining a flow rate of coolant when the head array unit includes a long liquid inlet.

As illustrated in FIGS. 13 and 17A, the head array unit 100A2 using the A method has a simple structure in which one coolant port 15 is provided on one end of the head array unit 100A2 and another coolant port 15 is provided on another end of the head array unit 100A2.

Figure 17B:
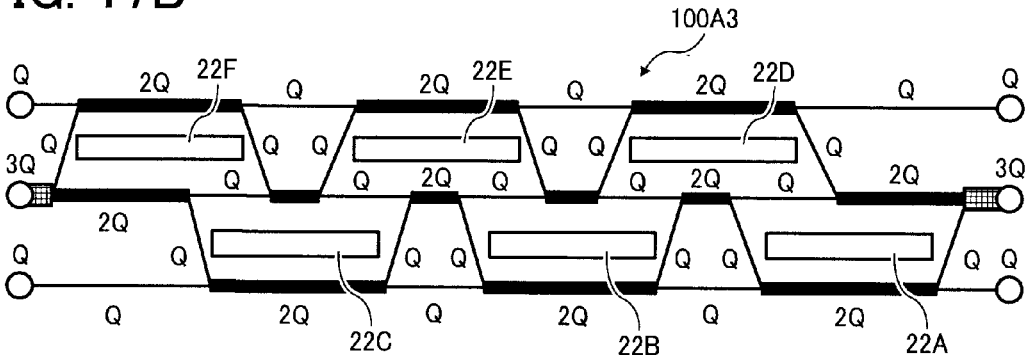
FIG. 17B is an illustration of the head array unit using the B method shown in FIG. 14 for explaining a flow rate of coolant when the head array unit includes a long liquid inlet.

As illustrated in FIGS. 14 and 17B, in the head array unit 100A3 using the B method, coolant in the large flow amount 2Q affects a whole long side of the liquid inlets 22A, 22B, 22C, 22D, 22E, and 22F, effectively controlling the temperature of the liquid discharging heads 1A, 1B, 1C, 1D, 1E, and 1F (depicted in FIG. 1).

Figure 17C:
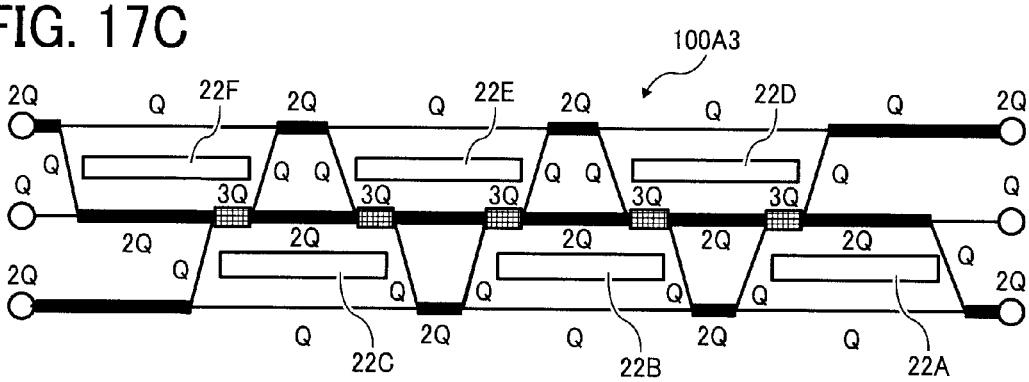
FIG. 17C is an illustration of the head array unit using the C method shown in FIG. 14 for explaining a flow rate of coolant when the head array unit includes a long liquid inlet.

As illustrated in FIGS. 14 and 17C, in the head array unit 100A3 using the C method, coolant in the large flow amounts 2Q and 3Q affects a whole long side of the liquid inlets 22A, 22B, 22C, 22D, 22E, and 22F, effectively controlling the temperature of the liquid discharging heads 1A, 1B, 1C, 1D, 1E, and 1F (depicted in FIG. 1).

In the head array unit 100A3 using the C method illustrated in FIG. 17C, coolant in the large flow amounts 2Q and 3Q flows in a center portion of the head array unit 100A3 in the width direction of the head array unit 100A3, which may easily store heat. However, in order to flow coolant in the large flow amounts 2Q and 3Q in a small space between the adjacent liquid inlets 22 in the width direction of the head array unit 100A3, the head array unit 100A3 need to have a sufficient width.

By contrast, in the head array unit 100A3 using the B method illustrated in FIG. 17B, the main channel 24 (depicted in FIG. 14) provided between the adjacent liquid inlets 22 in the width direction of the head array unit 100A3 may have a small width. Further, coolant in the large flow amount 2Q may flow in parallel to both long sides of each of the liquid inlets 22. Thus, the head array unit 100A3 using the B method may provide effective temperature control of the liquid discharging heads 1A, 1B, 1C, 1D, 1E, and 1F (depicted in FIG. 1) with a compact structure.

Figure 17D:
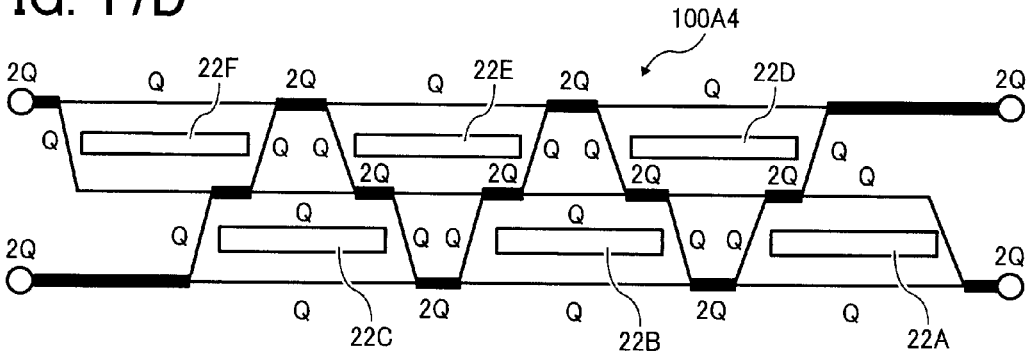
FIG. 17D is an illustration of the head array unit using the D method shown in FIG. 15 for explaining a flow rate of coolant when the head array unit includes a long liquid inlet.

As illustrated in FIGS. 15 and 17D, in the head array unit 100A4 using the D method, two coolant ports 15 are provided on one end of the head array unit 100A4 and another two coolant ports 15 are provided on another end of the head array unit 100A4. The head array unit 100A4 using the D method may have a simple structure although the head array unit 100A4 does not provide temperature control performance equivalent to temperature control performance provided by the head array unit 100A3 using the B method (depicted in FIG. 17B) and the head array unit 100A3 using the C method (depicted in FIG. 17C).

The head array unit 100A2 using the A method (depicted in FIG. 13) includes one coolant port 15 on each of both ends of the head array unit 100A2. Therefore, when any of the coolant ports 15 is faulty, the head array unit 100A2 may not perform temperature control. To address this problem, driving of the liquid discharging heads 1A, 1B, 1C, 1D, 1E, and 1F (depicted in FIG. 1) need to be restricted by decreasing a driving frequency of the liquid discharging heads 1A, 1B, 1C, 1D, 1E, and 1F. On the contrary, each of the head array unit 100A3 using the B method (depicted in FIG. 14), the head array unit 100A3 using the C method (depicted in FIG. 14), and the head array unit 100A4 using the D method (depicted in FIG. 15) includes the plurality of coolant ports 15 on each of both ends of the head array units 100A3 and 100A4. Therefore, even when one of the coolant ports 15 is faulty, the head array units 100A3 and 100A4 may provide temperature control. Accordingly, restriction of driving of the liquid discharging heads 1A, 1B, 1C, 1D, 1E, and 1F (depicted in FIG. 1) may be suppressed.

Figure 18:
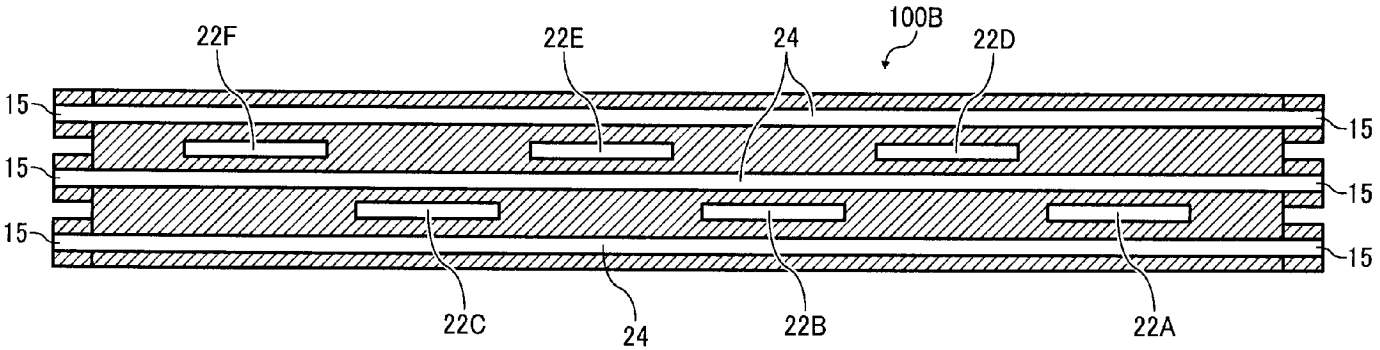
FIG. 18 is a sectional plane view of a head array unit according to yet another exemplary embodiment.

Referring to FIG. 18, the following describes a head array unit 100B according to yet another exemplary embodiment. FIG. 18 is a sectional plane view of the head array unit 100B. The head array unit 100B includes the elements common to the head array unit 100A depicted in FIG. 11, but does not include the sub channel 25.

As illustrated in FIG. 18, first and second main channels 24 sandwich the liquid inlets 22A, 22B, and 22C, and second and third main channels 24 sandwich the liquid inlets 22D, 22E, and 22F. Namely, the first and second main channels 24 sandwich the liquid discharging heads 1A, 1B, and 1C (depicted in FIG. 7), and the second and third main channels 24 sandwich the liquid discharging heads 1D, 1E, and 1F (depicted in FIG. 7). Accordingly, coolant flows along both sides of a row formed by the liquid discharging heads 1A, 1B, and 1C and along both sides of another row formed by the liquid discharging heads 1D, 1E, and 1F. Thus, the head array unit 100B may provide temperature control. The head array unit 100B may have a simple structure and thereby may be easily manufactured although the head array unit 100B does not provide temperature control performance equivalent to temperature control performance provided by the head array unit 100A (depicted in FIG. 11) including the sub channel 25 (depicted in FIG. 11).

Figure 19:
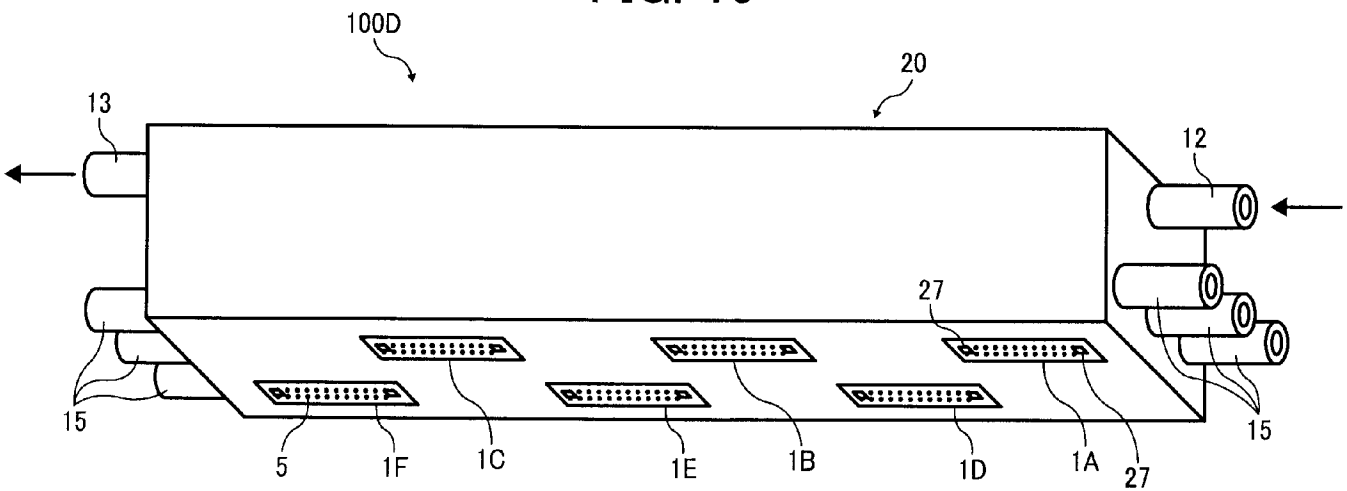
FIG. 19 is a perspective view of a head array unit according to yet another exemplary embodiment.

Referring to FIG. 19, the following describes a head array unit 100D according to yet another exemplary embodiment. FIG. 19 is a perspective view of the head array unit 100D. The head array unit 100D includes a temperature sensor 27. The other elements of the head array unit 100D are common to the head array unit 100A depicted in FIG. 7.

The temperature sensor 27 is provided in both ends of each of the liquid discharging heads 1A, 1B, 1C, 1D, 1E, and 1F.

When the liquid discharging heads 1A, 1B, 1C, 1D, 1E, and 1F discharge liquid, heat generated by the liquid discharging heads 1A, 1B, 1C, 1D, 1E, and 1F changes a temperature of the head array unit 100D. Coolant flown in the head array unit 100D controls the temperature of the head array unit 100D so that change in temperature of the head array unit 100D may not affect liquid discharging property. However, heat transmits between the liquid discharging heads 1A, 1B, 1C, 1D, 1E, and 1F and the coolant. Accordingly, a temperature of the coolant flown in the head array unit 100D also changes.

For example, coolant may be used as a refrigerant for suppressing heat generation of the head array unit 100D. In this case, when the head array unit 100D generates a substantial amount of heat, the temperature of coolant increases while coolant flows in the head array unit 100D. Consequently, the temperature of coolant flown near the coolant port 15 through which coolant enters the head array unit 100D may become different from the temperature of coolant flown near the coolant port 15 through which coolant goes out of the head array unit 100D, resulting in varied cooling effect. Namely, temperature distribution may generate in a longitudinal direction of the head array unit 100D, varying liquid discharging property in the longitudinal direction of the head array unit 100D.

To address this problem, the temperature sensor 27 is provided on both ends of each of the liquid discharging heads 1A, 1B, 1C, 1D, 1E, and 1F to detect temperature distribution in the head array unit 100D. A flow amount of coolant flowing in the head array unit 100D may be adjusted based on the detected temperature distribution. Further, a flow direction of coolant flowing in the head array unit 100D may be switched based on the detected temperature distribution to suppress a temperature gradient of the head array unit 100D.

According to this exemplary embodiment, one temperature sensor 27 is provided in both ends of each of the liquid discharging heads 1A, 1B, 1C, 1D, 1E, and 1F. Alternatively, the temperature sensor 27 may be provided in the head supporter 20. However, the temperature sensor 27 may be preferably provided in the liquid discharging head 1 because the temperature sensor 27 may be molded with a liquid discharging circuit (not shown) of the liquid discharging head 1.

According to this exemplary embodiment, two temperature sensors 27 are provided in each of the liquid discharging heads 1A, 1B, 1C, 1D, 1E, and 1F. Alternatively, one temperature sensor 27 may be provided in each of the liquid discharging heads 1A, 1B, 1C, 1D, 1E, and 1F. However, the two temperature sensors 27 provided in each of the liquid discharging heads 1A, 1B, 1C, 1D, 1E, and 1F may provide a precise temperature control. Namely, coolant may be controlled to cancel a temperature gradient in each of the liquid discharging heads 1A, 1B, 1C, 1D, 1E, and 1F.

In order to decrease a number of the temperature sensors 27, the temperature sensor 27 may be provided in the liquid discharging heads 1 (e.g., the liquid discharging heads 1A and 1F) provided near both ends of the head array unit 100D, for example. In this case, a flow direction of coolant may be controlled based on measurement information relating to the temperature gradient of the head array unit 100D.

According to this exemplary embodiment, the temperature sensor 27 detects temperature distribution in the head array unit 100D. Alternatively, the temperature distribution in the head array unit 100D may be anticipated based on a liquid discharging signal to control coolant.

Figure 20:
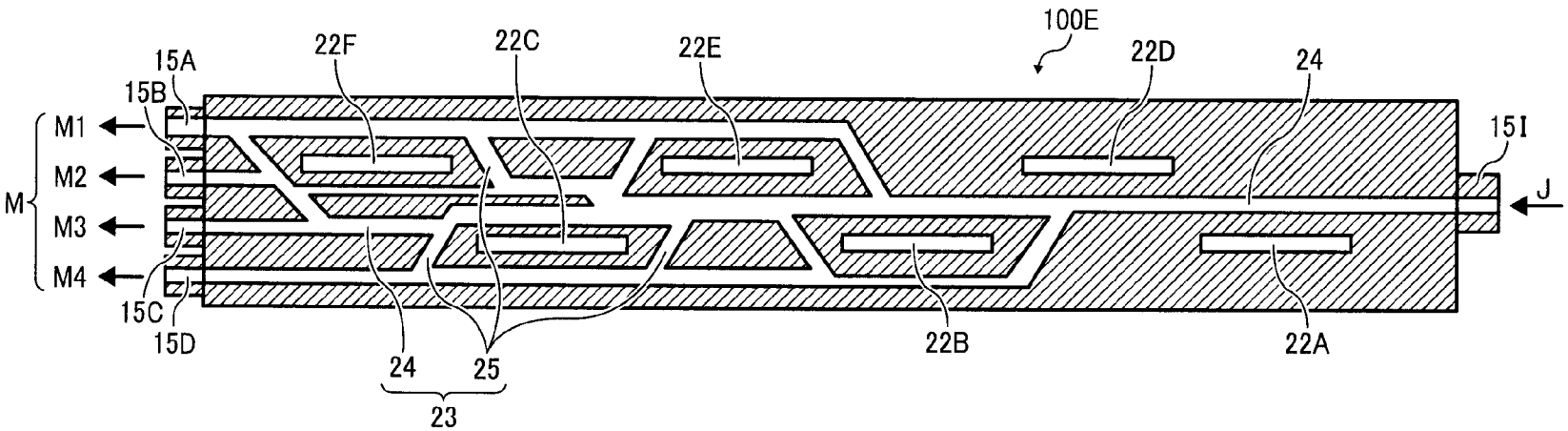
FIG. 20 is a sectional plane view of a head array unit according to yet another exemplary embodiment.

Referring to FIG. 20, the following describes a head array unit 100E according to yet another exemplary embodiment. FIG. 20 is a sectional plane view of the head array unit 100E. The head array unit 100E includes coolant ports 15A, 15B, 15C, 15D, and 15I instead of the coolant ports 15 depicted in FIG. 19. The other elements of the head array unit 100E are common to the head array unit 100D depicted in FIG. 19.

In the head array unit 100D (depicted in FIG. 19), the flow direction of coolant is controlled to suppress generation of the temperature gradient of the head array unit 100D. Alternatively, the temperature gradient of the head array unit 100D may be suppressed by modifying the structure of the head array unit 100D without changing the flow direction of coolant.

For example, in the head array unit 100E (depicted in FIG. 20), the coolant channel 23, in which coolant flows, extends from an inlet (e.g., the coolant port 15I) of coolant to outlets (e.g., the coolant ports 15A, 15B, 15C, and 15D) of coolant in such a manner that the coolant channel 23 successively branches from the inlet to the outlet. Accordingly, coolant flows in directions J and M including directions M1, M2, M3, and M4.

Coolant may be used as a refrigerant for cooling the head array unit 100E. In this case, coolant enters the coolant port 15I and flows near the liquid inlets 22A, 22D, 22B, 22E, 22C, and 22F in this order. Namely, coolant cools the liquid discharging heads 1A, 1D, 1B, 1E, 1C, and 1F (depicted in FIG. 19) in this order. As coolant flows closer to the coolant ports 15A, 15B, 15C, and 15D, a temperature of coolant increases. Accordingly, cooling performance of coolant decreases. To address this problem, a number of the main channels 24 and the sub channels 25 is increased as coolant flows from an upstream (e.g., the coolant port 15I) toward a downstream (e.g., the coolant ports 15A, 15B, 15C, and 15D) of the head array unit 100E in a liquid flow direction. Namely, a surface area, on which heat is transmitted between the liquid discharging heads 1A, 1D, 1B, 1E, 1C, and 1F and the coolant channel 23, increases as coolant flows from the upstream toward the downstream. Consequently, heat may be transmitted more efficiently in the downstream. In other words, heat transmission efficiency increases as coolant flows in one direction from the upstream toward the downstream.

Since the coolant channel 23 provides an increased efficiency of heat transmission in the downstream, a temperature of the liquid discharging heads 1A, 1B, 1C, 1D, 1E, and 1F may be adjusted to a uniform temperature even when the temperature of coolant in the upstream is different from the temperature of coolant in the downstream.

According to this exemplary embodiment, the number of the main channels 24 and the sub channels 25 is increased to increase the surface area, on which heat is transmitted between the liquid discharging heads 1A, 1D, 1B, 1E, 1C, and 1F and the coolant channel 23, so that a downstream of the coolant channel 23 may provide a heat transmission efficiency higher than a heat transmission efficiency in an upstream of the coolant channel 23. Alternatively, a distance between the coolant channel 23 and the liquid discharging head 1 in the downstream may be shorter than a distance between the coolant channel 23 and the liquid discharging head 1 in the upstream. Yet alternatively, the coolant channel 23 may occupy a larger area of the head supporter 20 (depicted in FIG. 19) in the downstream than in the upstream. Yet alternatively, a fan may cool the downstream of the head array unit 100E or the head array unit 100E may have a shape in which heat is radiated more easily in the downstream than in the upstream.

According to this exemplary embodiment, four coolant ports 15A, 15B, 15C, and 15D are provided in the downstream of the head array unit 100E. Alternatively, one coolant port 15 may be provided in the downstream of the head array unit 100E. When a plurality of coolant ports 15 is provided, a valve may be provided in a downstream from the coolant ports 15 in the liquid flow direction. The valve may be properly moved according to a measured temperature distribution of the head array unit 100E so as to control the temperature distribution of the head array unit 100E with an improved precision.

According to the above-described exemplary embodiments, in the head array units 100 (depicted in FIG. 1), 100A (depicted in FIG. 7), 100A1 (depicted in FIG. 12), 100A2 to 100A4 (depicted in FIGS. 13 to 15, respectively), 100B (depicted in FIG. 18), 100D (depicted in FIG. 19), and 100E (depicted in FIG. 20), six liquid discharging heads 1A, 1B, 1C, 1D, 1E, and 1F are staggered to form a first row of the liquid discharging heads 1A, 1B, and 1C and a second row of the liquid discharging heads 1D, 1E, and 1F. Alternatively, according to an arrangement of the liquid discharging heads 1 having a substantial number of liquid discharging openings aligned two-dimensionally, the coolant channel 23 formed of a honeycomb tube may be provided on a back surface of the liquid discharging head 1 to surround the liquid inlet 22. Coolant flows in the coolant channel 23 to control a temperature of the whole back surface of the liquid discharging head 1 thoroughly and effectively.

According to the above-described exemplary embodiments, one or more coolant ports 15, through which coolant enters and goes out of the head supporter 20 (depicted in FIG. 1), are provided on both ends of the head supporter 20 in the longitudinal direction of the head supporter 20. Alternatively, the coolant ports 15 may be provided at proper positions in the longitudinal direction of the head supporter 20 so as to divide the head supporter 20 into a plurality of blocks and perform temperature control per block.

As illustrated in FIG. 1, according to the above-described exemplary embodiments, the head array unit 100 includes the plurality of liquid discharging heads 1A, 1B, 1C, 1D, 1E, and 1F and the head supporter 20. The liquid discharging heads 1A, 1B, 1C, 1D, 1E, and 1F discharge a liquid drop, and are provided or staggered on the head supporter 20. As illustrated in FIG. 5, the head supporter 20 includes the liquid inlets 22A, 22B, 22C, 22D, 22E, and 22F, the coolant channel 23, and at least two coolant ports 15. The liquid inlets 22A, 22B, 22C, 22D, 22E, and 22F supply liquid (e.g., ink) to the liquid discharging heads 1A, 1B, 1C, 1D, 1E, and 1F (depicted in FIG. 1), respectively. The coolant channel 23 sandwiches or surrounds each of the liquid inlets 22A, 22B, 22C, 22D, 22E, and 22F and contains coolant flowing to control the temperature of the head array unit 100. The coolant ports 15 are connected to the coolant channel 23. Thus, the head supporter 20 may effectively suppress temperature increase of the liquid discharging heads 1A, 1B, 1C, 1D, 1E, and 1F, so that the liquid discharging heads 1A, 1B, 1C, 1D, 1E, and 1F may maintain stable liquid discharging performance.

Figure 21:
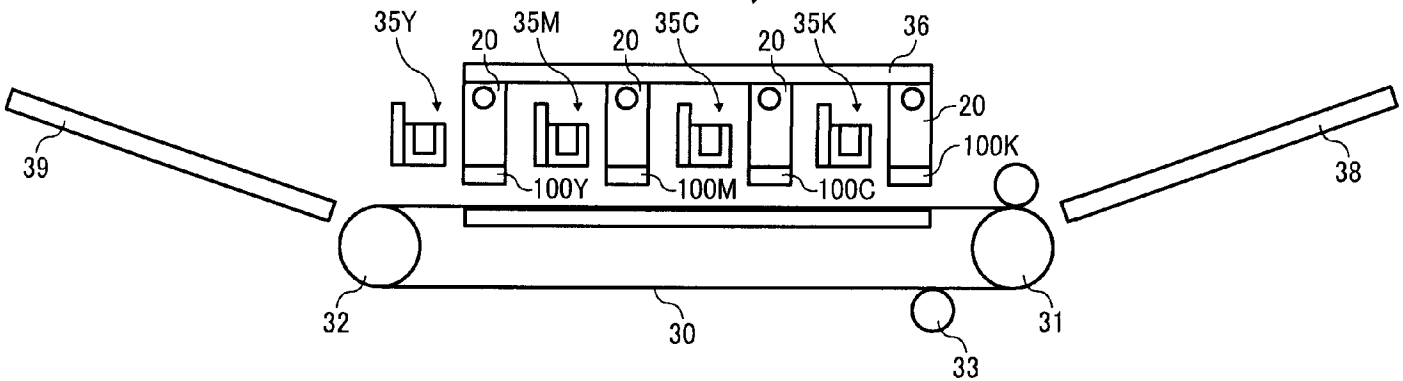
FIG. 21 is a sectional view of an image forming apparatus according to yet another exemplary embodiment during an image forming operation.
Figure 22:
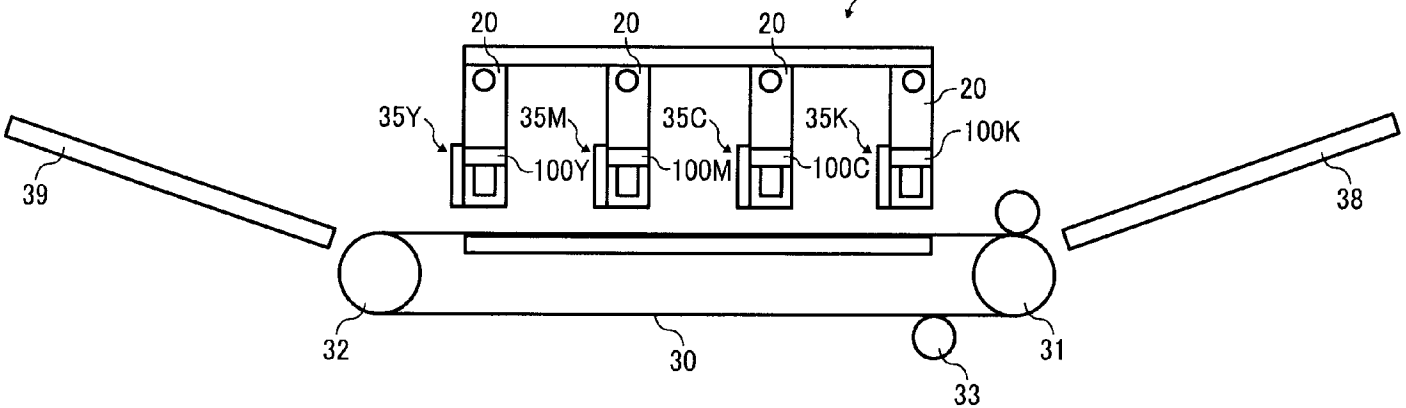
FIG. 22 is a sectional view of the image forming apparatus shown in FIG. 21 during a recovery operation.
Figure 23:
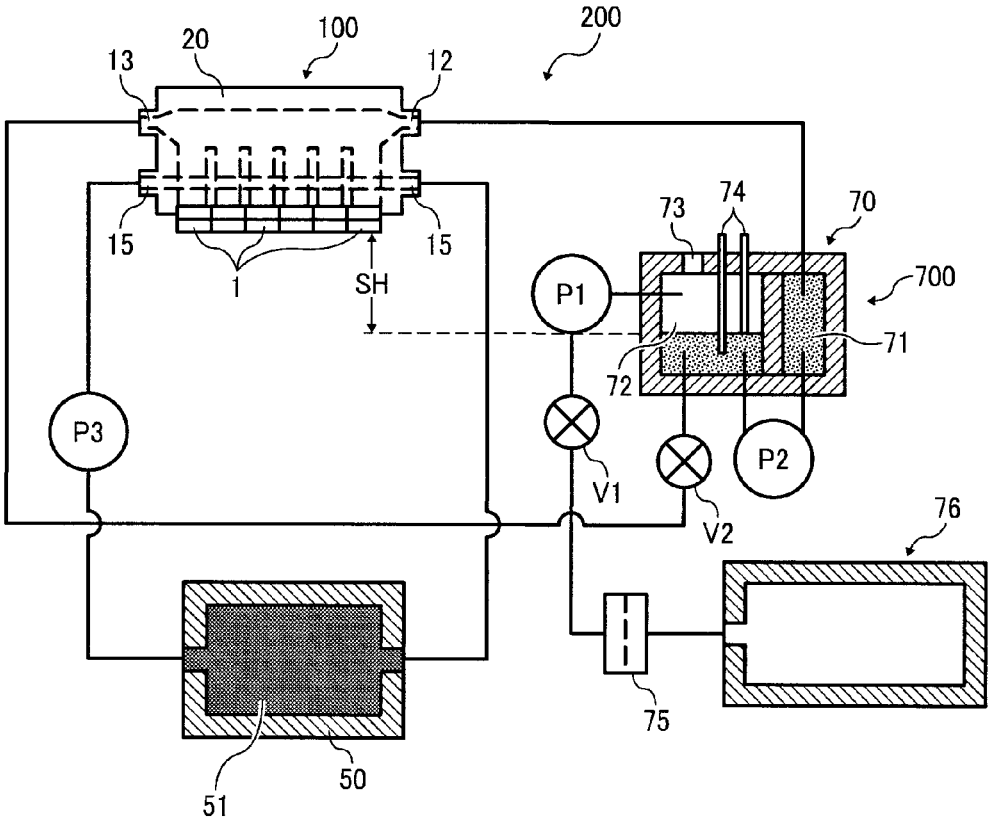
FIG. 23 is a schematic view of the image forming apparatus shown in FIG. 21.

Referring to FIGS. 21 to 23, the following describes an image forming apparatus 200 according to yet another exemplary embodiment. The image forming apparatus 200 includes the head array unit 100 (depicted in FIG. 1), 100A (depicted in FIG. 7), 100A1 (depicted in FIG. 12), 100A2 (depicted in FIG. 13), 100A3 (depicted in FIG. 14), 100A4 (depicted in FIG. 15), 100B (depicted in FIG. 18), 100D (depicted in FIG. 19), or 100E (depicted in FIG. 20).

FIG. 21 is a sectional view of the image forming apparatus 200 during an image forming operation. FIG. 22 is a sectional view of the image forming apparatus 200 during a recovery operation. As illustrated in FIG. 21, the image forming apparatus 200 includes recording heads 100K, 100C, 100M, and 100Y, a head frame 36, a paper tray 38, a sheet-conveying belt 30, an output tray 39, a belt-driving roller 31, a tension roller 32, a charging roller 33, and maintenance units 35K, 35C, 35M, and 35Y.

The image forming apparatus 200 can be any of a copier, a printer, a facsimile machine, a plotter, and a multifunction printer including at least one of copying, printing, scanning, plotter, and facsimile functions. In this non-limiting exemplary embodiment, the image forming apparatus 200 functions as an inkjet printer for discharging liquid (e.g., ink) to form an image on a recording medium (e.g., a recording sheet). Alternatively, the image forming apparatus 200 may discharge liquid other than ink, such as a DNA sample, a resist material, and a pattern material.

The image forming apparatus 200 serves as a line-type printer in which each of the recording heads 100K, 100C, 100M, and 100Y serves as a head array unit having a length corresponding to a maximum width of a recording sheet conveyed in the image forming apparatus 200. The recording heads 100K, 100C, 100M, and 100Y discharge inks in colors different from each other, for example, black, cyan, magenta, and yellow inks, respectively. The four recording heads 100K, 100C, 100M, and 100Y are attached to the head frame 36. A head lifting mechanism (not shown) moves up and down the four recording heads 100K, 100C, 100M, and 100Y simultaneously.

The recording heads 100K, 100C, 100M, and 100Y discharge the black, cyan, magenta, and yellow inks, respectively, onto a recording sheet conveyed below the recording heads 100K, 100C, 100M, and 100Y to form an image on the recording sheet. The paper tray 38 loads recording sheets. A separate-feed mechanism (not shown) separates an uppermost recording sheet from other recording sheets loaded on the paper tray 38 and feeds the uppermost recording sheet toward the sheet-conveying belt 30. The sheet-conveying belt 30 conveys the recording sheet to the output tray 39. For example, while the sheet-conveying belt 30 conveys the recording sheet, the recording heads 100K, 100C, 100M, and 100Y discharge the black, cyan, magenta, and yellow inks onto the recording sheet to form an image on the recording sheet. The recording sheet bearing the image is output onto the output tray 39.

The sheet-conveying belt 30 is looped over the belt-driving roller 31 and the tension roller 32. The sheet-conveying belt 30 includes two layers, that is, a high-resistance layer serving as a front layer and a medium-resistance layer serving as a back layer. The high-resistance layer includes a resin material. The medium-resistance layer is formed by performing resistance control on a resin material with a carbon. The charging roller 33 contacts the sheet-conveying belt 30, and includes a metal roller, a medium-resistance layer formed on the metal roller, and a thin high-resistance layer formed on the medium-resistance layer.

When a high voltage is applied to the charging roller 33, an electric discharge generates in an air gap near a nip formed between the sheet-conveying belt 30 and the charging roller 33 and an electric charge is attracted to the sheet-conveying belt 30. When an alternating voltage including positive and negative charges is applied to the charging roller 33, the positive and negative charges are attracted to the sheet-conveying belt 30 alternately to form stripes. Accordingly, when a recording sheet is sent to the charged sheet-conveying belt 30, an electrostatic force attracts the recording sheet to the sheet-conveying belt 30. Namely, an image is printed on the recording sheet while the sheet-conveying belt 30 holds the recoding sheet with a strong forth. Therefore, even when the sheet-conveying belt 30 conveys the recording sheet at a high speed, the image forming apparatus 200 may provide a stable print quality.

Each of the recording heads 100K, 100C, 100M, and 100Y is equivalent to the head array unit 100 (depicted in FIG. 1), and includes the liquid discharging heads 1A, 1B, 1C, 1D, 1E, and 1F (depicted in FIG. 1). As illustrated in FIG. 6, the liquid discharging head 1 uses a thermal method in which the heat generating element 4 is driven to cause film boiling in ink. The film boiling generates pressure for discharging ink from the nozzle 5. The liquid discharging head 1 uses the side shooter method in which a direction of liquid (e.g., ink) flowing to the discharge energy acting portion (e.g., the heat generator) is perpendicular to the center axis of the opening of the nozzle 5.

The side shooter method may effectively convert energy generated by the heat generating element 4 into energy for forming an ink drop and shooting the ink drop. Further, the side shooter method may quickly recover meniscus by supplying ink. The side shooter method may also prevent a problem caused by an edge shooter method, that is, a cavitation phenomenon in which an impact generated when an air bubble disappears gradually destroys the heat generating element 4. For example, when an air bubble grows in the side shooter method and reaches the nozzle 5, the air bubble is released into air. Therefore, the air bubble may not shrink due to temperature decrease. Consequently, the recording heads 100K, 100C, 100M, and 100Y may have a long life.

The following describes one example method for manufacturing the liquid discharging head 1. A silicon wafer including a $SiO_2$ film formed by thermal oxidation is prepared. A heat generation resistance layer including $HfB_2$ is layered on the silicon wafer by RF magnetron sputtering. An electrode layer including aluminum is layered on the heat generation resistance layer by an EB evaporation method. The aluminum layer is etched with phosphate nitrate etching liquid by photo lithography. The heat generation resistance layer is etched by reactive ion etching. In order to expose the heat generating element 4, a resist film is formed in a portion other than an expose portion and processed with etching liquid. Aluminum in a portion without the resist film is etched and the heat generating element 4 is provided between two electrodes forming an electrode pair. A $SiO_2$ layer serving as a protective layer is provided on an electric heat converter and a polyimide layer is provided on a portion other, than a portion in which the heat generating element 4 is provided. Thus, the heat generating base 2 is manufactured.

Polymethyl isopropenyl ketone (e.g., ODUR-1010 available from TOKYO OHKA KOGYO CO., LTD.) is applied on PET and dried into a dry film. The dry film, serving as a soluble resin layer, is transferred and laminated on the heat generating base 2. After pre-bake, pattern exposure and development with a mixture of methylisobutylketone and xylene at a ratio of 2 to 1 are performed on the resin layer to form the individual liquid chamber 6. A resin constituent formed of an epoxy resin, a photocation polymerization initiator, and a silane coupling agent is dissolved in a mixed solvent of methyl isobutyl ketone and xylene at a concentration of 50 weight percent to form a photosensitive coated resin layer by spin coating. After pattern exposure corresponding to the nozzle 5 and after-bake are performed on the photosensitive coated resin layer, the photosensitive coated resin layer is developed with methyl isobutyl ketone to form the nozzle 5.

The photosensitive coated resin layer is soaked while ultrasonic wave is applied in methyl isobutyl ketone to elute a residual soluble resin. Then, the photosensitive coated resin layer is heated for an hour at 150 degrees centigrade so as to be hardened. Finally, the shared liquid chamber 7 is formed by silicone anisotropic etching with TMAH (tetramethylammonium hydroxide aqueous solution). In order to prevent damage to the heat generating base 2, a protective layer formed of a cyclized rubber protects a surface of the heat generating base 2 facing the nozzle 5.

Thus, a short liquid discharging head 1 in which 1200 pieces of the nozzles 5 are arranged in one row is manufactured. In the short liquid discharging head 1, the nozzles 5 are arranged to provide a resolution of 600 dpi per row and a distance of 240 μm is provided between adjacent rows.

As illustrated in FIG. 2, the head supporter 20, to which the liquid discharging head 1 is attached, includes the liquid inlet 22 connected to the shared liquid chamber 7 (depicted in FIG. 3) of the liquid discharging head 1 and the liquid channel 21. As illustrated in FIG. 3, the inlet port 12 and the outlet port 13 are provided on both ends of the head supporter 20 in the longitudinal direction of the head supporter 20, and connected to the liquid channel 21. The coolant channel 23 is provided between the liquid channel 21 and the liquid discharging head 1. The coolant ports 15 are provided on the head supporter 20, and connected to the coolant channel 23.

As illustrated in FIG. 2, the head supporter 20 may be divided into an upper portion and a lower portion at a border shown by arrows K-K. The lower portion, to which the liquid discharging head 1 is attached, is manufactured by lamination of cut stainless. The upper portion, which forms the liquid channel 21, is molded with a modified PPE resin. The lower portion and the upper portion are adhered to each other to form the head supporter 20. As illustrated in FIG. 1, six liquid discharging heads 1 (e.g., the liquid discharging heads 1A, 1B, 1C, 1D, 1E, and 1F) are attached to one head supporter 20, and identical color ink is supplied to the six liquid discharging heads 1. Thus, the six liquid discharging heads 1 may provide a recording width six times greater than a recording width provided by a single liquid discharging head 1.

FIG. 23 is a schematic view of the image forming apparatus 200. The image forming apparatus 200 further includes an ink supply system 700, a pump P3, and a coolant tank 50. The ink supply system 700 includes a head tank 70, a pump P2, an ink cartridge 76, a filter 75, a pump P1, a valve V2, and a valve V1. The head tank 70 includes a first ink chamber 71, a second ink chamber 72, an air outlet 73, and an ink level sensor 74.

Figure 24:
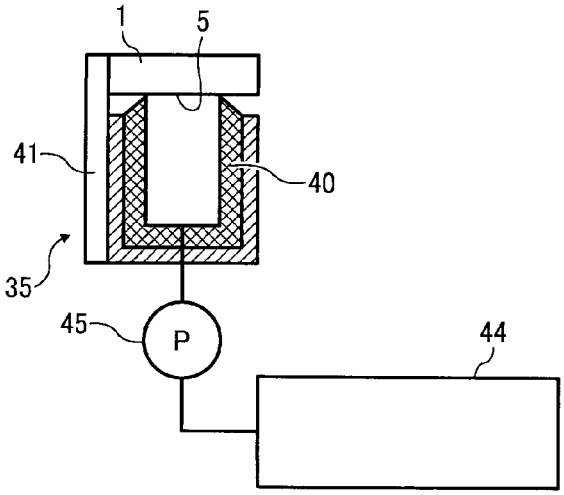
FIG. 24 is a sectional view of a maintenance unit included in the image forming apparatus shown in FIG. 21 during a recovery operation.
Figure 25:
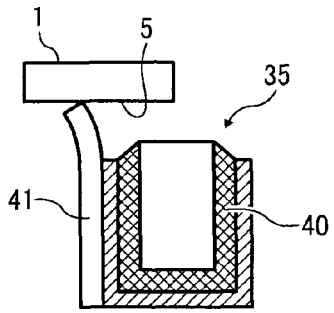
FIG. 25 is a sectional view of the maintenance unit shown in FIG. 24 during a wiping operation.

FIG. 24 is a sectional view of the maintenance unit 35 (e.g., the maintenance units 35K, 35C, 35M, and 35Y depicted in FIG. 21) during a recovery operation. The maintenance unit 35 includes a cap 40, a wiper blade 41, a pump 45, and a waste ink tank 44. FIG. 25 is a sectional view of the maintenance unit 35 during a wiping operation.

As illustrated in FIG. 23, the head array unit 100 is equivalent to each of the recording heads 100K, 100C, 100M, and 100Y depicted in FIG. 21. The ink supply system 700 functions as an ink supply route connected to the head array unit 100. In the ink supply system 700, the head tank 70 supplies ink to the head array unit 100, and receives an air bubble and discharges the air bubble to an outside of the head tank 70. An inside of the head tank 70 is divided into the first ink chamber 71 and the second ink chamber 72. The air outlet 73 is provided in an upper portion of the second ink chamber 72. The pump P2 moves ink from the second ink chamber 72 to the first ink chamber 71. The ink cartridge 76 is connected to the second ink chamber 72. Ink discharged from the ink cartridge 76 filters through the filter 75. The pump P1 moves the filtered ink toward the second ink chamber 72 of the head tank 70.

An ink port (not shown) is provided on a bottom of the second ink chamber 72, and connected to the outlet port 13 of the head supporter 20 of the head array unit 100 via the valve V2 constantly opened. The ink level sensor 74 detects an ink level in the second ink chamber 72. An amount of ink contained in the second ink chamber 72 is controlled based on a detection result provided by the ink level sensor 74, so that a difference SH between an ink level in the second ink chamber 72 and an ink head in the head array unit 100 is maintained at a predetermined value of from about 10 mm to about 150 mm.

In a normal image forming mode, the pumps P1 and P2 are stopped and the valve V2 is opened. Ink is supplied from the second ink chamber 72 to the head array unit 100 via the outlet port 13. When the ink level sensor 74 detects that the ink level in the second ink chamber 72 is below a predetermined level due to ink consumption, the valve V1 is opened and the pump P1 is driven to supply ink from the ink cartridge 76 to the second ink chamber 72. The ink supply is stopped based on a detection result provided by the ink level sensor 74.

When the liquid discharging head 1 is clogged, a recovery operation for recovering the head array unit 100 is performed. For example, as illustrated in FIG. 21, the recording heads 100K, 100C, 100M, and 100Y, serving as the head array units 100 (depicted in FIG. 23), respectively, move upward and the maintenance units 35K, 35C, 35M, and 35Y move in a horizontal direction (e.g., in a rightward direction in FIG. 21), so that the maintenance units 35K, 35C, 35M, and 35Y are disposed directly below the recording heads 100K, 100C, 100M, and 100Y, respectively, as illustrated in FIG. 22. The recording heads 100K, 100C, 100M, and 100Y move down slightly, so that the liquid discharging head 1 contacts the cap 40 of the maintenance unit 35 as illustrated in FIG. 24.

As illustrated in FIG. 23, when the valves V1 and V2 are closed and the pump P2 is driven for a predetermined time period, pressure is applied to ink in the first ink chamber 71 and ink flows into the head array unit 100. Ink is discharged from the nozzle 5 (depicted in FIG. 24) of the head array unit 100, because the valve V2 is closed. An air bubble and a foreign substance clogging the liquid discharging head 1 (depicted in FIG. 24) are also removed together with the discharged ink. After the pump P2 is stopped, the head array unit 100 moves up to a level at which the head array unit 100 does not contact the cap 40 (depicted in FIG. 24). The maintenance unit 35 moves in the horizontal direction (e.g., in the rightward direction in FIG. 22), so that the wiper blade 41 wipes a nozzle surface of the nozzle 5 as illustrated in FIG. 25. After the wiping forms meniscus on the nozzle 5, the valve V2 is opened so that the head array unit 100 has a negative pressure corresponding to the difference SH.

As illustrated in FIG. 24, ink discharged from the head array unit 100 (depicted in FIG. 23) is accumulated inside the cap 40. The pump 45 sucks the accumulated ink and discharges the sucked ink into the waste ink tank 44. Alternatively, a filter (not shown) may be provided in the cap 40 so that the accumulated ink filters through the filter. Accordingly, the filtered ink may be sent back to the second ink chamber 72 (depicted in FIG. 23) instead of the waste ink tank 44 for reuse.

The head array unit 100 moves up and the maintenance unit 35 moves in the horizontal direction, so that the recording heads 100K, 100C, 100M, and 100Y serving as the head array units 100, respectively, and the maintenance units 35K, 35C, 35M, and 35Y are positioned as illustrated in FIG. 21 to perform an image forming operation. Alternatively, the recording heads 100K, 100C, 100M, and 100Y and the maintenance units 35K, 35C, 35M, and 35Y are positioned as illustrated in FIG. 22 to wait for a next image forming command. The above-described recovery operations may eliminate clogging of the recording heads 100K, 100C, 100M, and 100Y and may maintain a proper condition of the recording heads 100K, 100C, 100M, and 100Y.

As illustrated in FIG. 23, the coolant tank 50 is connected to the coolant port 15 of the head supporter 20 via a resin tube (not shown) and the pump P3, so as to form a channel through which coolant 51 (e.g., water) contained in the coolant tank 50 is circulated.

A first print test was performed with the image forming apparatus 200 having the above-described structure. When the image forming apparatus 200 continuously performed image forming operations without supplying the coolant 51 to the head array unit 100, the image forming apparatus 200 formed a text image properly. However, the image forming apparatus 200 could not form a photographic image properly. Specifically, the image forming apparatus 200 provided proper image quality initially. After the image forming apparatus 200 formed a photographic image on about 500 recording sheets, many dusty dots not forming a proper photographic image were adhered to a recording sheet and thereby a desired photographic image was not formed on the recording sheet.

When the image forming apparatus 200 continuously performed image forming operations by circulating the coolant 51 to the head array unit 100 with a flow of 2 cc per second, the image forming apparatus 200 continuously formed a photographic image properly even after the image forming apparatus 200 formed a photographic image on about 500 recording sheets.

The following describes another configuration of the image forming apparatus 200 according to yet another exemplary embodiment. The image forming apparatus 200 includes the head array unit 100D in which six liquid discharging heads 1A, 1B, 1C, 1D, 1E, and 1F, each of which including the temperature sensors 27, are fixed on the head supporter 20 as illustrated in FIG. 19. The head supporter 20 includes the liquid channel 21 (depicted in FIG. 8) and the coolant channel 23 formed of a honeycomb tube as illustrated in FIG. 11. As illustrated in FIG. 8, the head supporter 20 is divided into an upper portion and a lower portion at a border shown by arrows L-L. The lower portion, to which the liquid discharging head 1 is attached, is manufactured by lamination of cut stainless. The upper portion, which forms the liquid channel 21, is molded with a modified PPE resin. The lower portion and the upper portion are adhered to each other to form the head supporter 20.

A second print test equivalent to the above-described first print test was performed with such image forming apparatus 200. Specifically, as illustrated in FIG. 23, a resin tube (not shown) was connected to the coolant port 15, so that the coolant tank 50 and the head array unit 100D (depicted in FIG. 19), including the coolant channel 23 formed of the honeycomb tube as illustrated in FIG. 11, formed a circulation system for circulating water serving as the coolant 51 at the flow rate illustrated in FIG. 17B.

When the image forming apparatus 200 continuously performed image forming operations by circulating the coolant 51 to the head array unit 100D with a flow of 1 cc per second, the image forming apparatus 200 continuously formed a photographic image on a substantial number of recording sheets properly. The head array unit 100D included the tubular coolant channel 23. Therefore, the coolant 51 was circulated in the coolant channel 23 with an increased reliability compared to the head array unit 100 used in the first print test, providing a similar effect even with the decreased flow.

A third print test was performed when the image forming apparatus 200 continuously formed a solid image on a substantial number of recording sheets by using the head array unit 100D. The third print test showed that the liquid discharging head 1F (depicted in FIG. 19) formed a faulty image. The temperature sensor 27 provided in the liquid discharging head 1A (depicted in FIG. 19) detected a lowest temperature and the temperature sensor 27 provided in the liquid discharging head 1F detected a highest temperature. A difference between the lowest temperature and the highest temperature detected by the liquid discharging heads 1A and 1F, respectively, was 10 degrees centigrade. When the coolant 51 flew with a flow of 2 cc per second, a difference between a lowest temperature and a highest temperature detected by the liquid discharging heads 1A and 1F, respectively, was decreased to 3 degrees centigrade. Consequently, even when the image forming apparatus 200 continuously formed a solid image on a substantial number of recording sheets, the liquid discharging head 1F did not form a faulty image.

When the pump P3 (depicted in FIG. 23) sent the coolant 51 in an opposite direction based on a value output by the temperature sensors 27 of the six liquid discharging heads 1A, 1B, 1C, 1D, 1E, and 1F, a temperature difference among the six liquid discharging heads 1A, 1B, 1C, 1D, 1E, and 1F was suppressed within about 4 degrees centigrade even when the coolant 51 flew with a flow of 1 cc per second. Thus, the image forming apparatus 200 continuously formed a solid image properly.

As illustrated in FIG. 23, when the image forming apparatus 200 includes the ink supply system 700 for circulating ink to be discharged from the liquid discharging heads 1, the pump P2 is driven while the valve V2 is opened. Accordingly, ink may be discharged from the liquid discharging heads 1 while ink is slowly circulated through the liquid channel 21 (depicted in FIG. 8). In this case, the coolant 51 may flow in the coolant channel 23 (depicted in FIG. 8) in a direction opposite to a direction in which ink flows in the liquid channel 21 to suppress temperature gradient in the head array unit 100A (depicted in FIG. 8).

Figure 26:
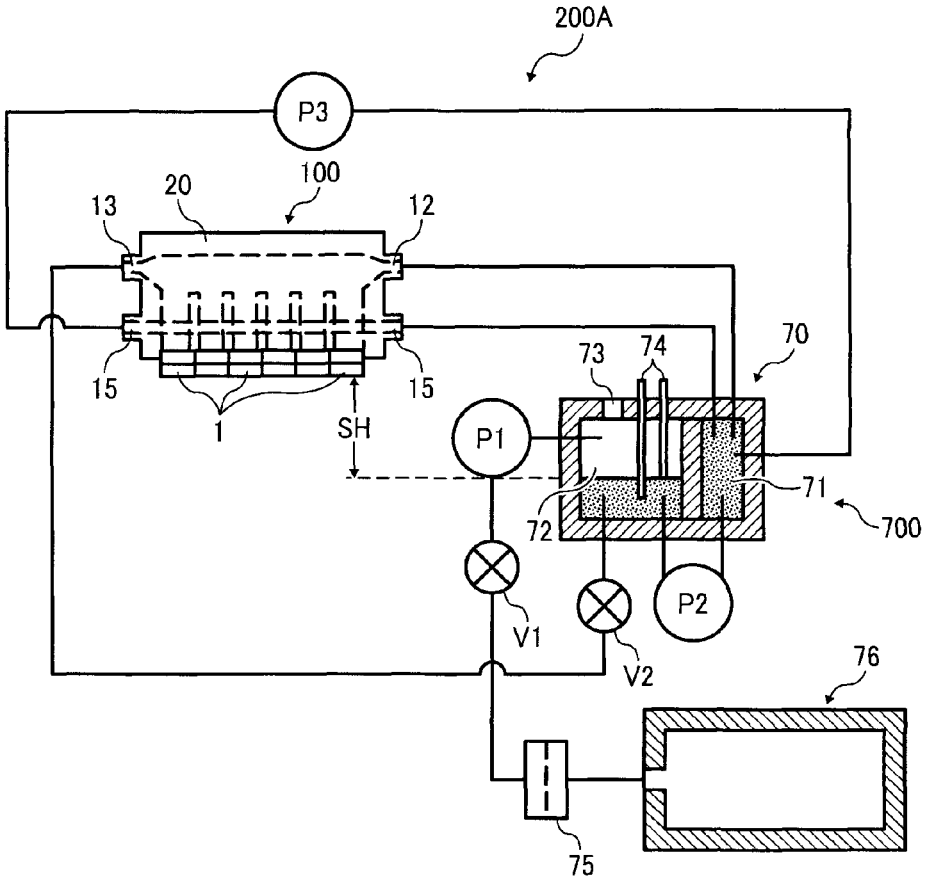
FIG. 26 is a schematic view of an image forming apparatus according to yet another exemplary embodiment.

Referring to FIG. 26, the following describes an image forming apparatus 200A according to yet another exemplary embodiment. FIG. 26 is a schematic view of the image forming apparatus 200A. The image forming apparatus 200A does not include the coolant tank 50 depicted in FIG. 23 and the pump P3 is provided between the head array unit 100 and the ink supply system 700. The other elements of the image forming apparatus 200A are common to the image forming apparatus 200 depicted in FIG. 23.

In the image forming apparatus 200A, ink to be discharged from the head array unit 100 is used as coolant to be supplied to the head array unit 100. Specifically, one of the coolant ports 15 is directly connected to the first ink chamber 71 and another one of the coolant ports 15 is connected to the first ink chamber 71 via the pump P3.

The structure of the image forming apparatus 200A is not preferable when the head array unit 100 discharges high-viscosity ink, because a great load is applied to the pump P3 to provide a flow of ink needed for temperature control. However, when the head array unit 100 discharges low-viscosity ink, a great load is not applied to the pump P3 and the coolant tank 50 is not needed, resulting in a simple structure of the image forming apparatus 200A.

Alternatively, a heating device or a cooling device may be connected to a part of a channel or a channel including the coolant tank 50 for conveying coolant, so as to heat or cool coolant.

Figure 27:
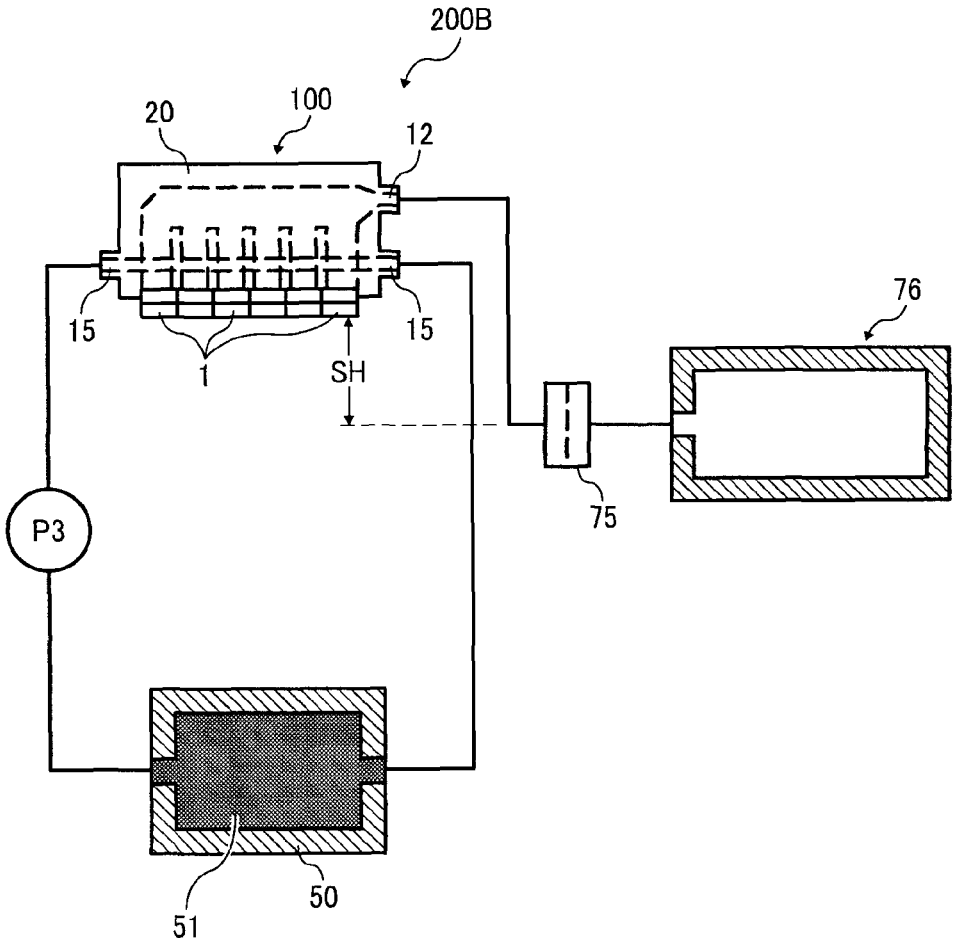
FIG. 27 is a schematic view of an image forming apparatus according to yet another exemplary embodiment.

Referring to FIG. 27, the following describes an image forming apparatus 200B according to yet another exemplary embodiment. FIG. 27 is a schematic view of the image forming apparatus 200B. The image forming apparatus 200B does not include the head tank 70, the pump P2, the pump P1, the valve V2, and the valve V1 depicted in FIG. 23. The other elements of the image forming apparatus 200B are common to the image forming apparatus 200 depicted in FIG. 23.

Ink to be discharged from the head array unit 100 is not supplied from the ink cartridge 76 via the head tank 70 (depicted in FIG. 23) because the image forming apparatus 200B does not include the head tank 70. Namely, ink to be discharged from the head array unit 100 is directly supplied from the ink cartridge 76 to the head array unit 100 and is not circulated by the head tank 70.

Alternatively, a head array unit may include a plurality of staggered short liquid discharging heads. The liquid discharging head may include a plurality of nozzle arrays arranged two-dimensionally and a plurality of liquid inlets for supplying liquid (e.g., ink) to the nozzle arrays. A coolant channel may be provided on a back surface of the nozzle arrays to surround the liquid inlets, so as to provide effects similar to the effects provided by the above-described exemplary embodiments.

The image forming apparatus (e.g., the image forming apparatus 200 depicted in FIG. 23, 200A depicted in FIG. 26, and 200B depicted in FIG. 27), which includes the liquid discharging head (e.g., the liquid discharging heads 1 depicted in FIGS. 23, 26, and 27) according to the above-described exemplary embodiments, may be applied to or may include an image forming apparatus having one of copying, printing, plotter, and facsimile functions, an image forming apparatus (e.g., a multi-function printer) having at least one of copying, printing, plotter, and facsimile functions, or the like. The above-described exemplary embodiments may be applied to an image forming apparatus using liquid other than ink, fixing liquid, and/or the like.

According to the above-described exemplary embodiments, the image forming apparatus includes an apparatus for forming an image by discharging liquid. A recording medium, on which the image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. Liquid, with which the image forming apparatus forms an image, is not limited to ink but includes any fluid and any substance which becomes fluid when discharged from the liquid discharging head. The liquid discharging head may discharge liquid not forming an image as well as liquid forming an image.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2007-216353 filed on Aug. 22, 2007 in the Japan Patent Office, the entire contents of which are hereby incorporated herein by reference.

What is claimed is:

1. A head array unit, comprising:

a plurality of liquid discharging heads configured to discharge liquid; and a head supporter configured to support the plurality of liquid discharging heads, the head supporter comprising:

a plurality of liquid inlets configured to supply liquid to the plurality of liquid discharging heads, respectively;

a channel system through which coolant flows to control a temperature of the head array unit and including a plurality of coolant channels disposed between the plurality of liquid inlets to sandwich each of the plurality of liquid inlets; and at least two ports connected to each coolant channel of the plurality of coolant channels of the channel system.

2. A head array unit, comprising:

a plurality of liquid discharging heads configured to discharge liquid; and a head supporter configured to support the plurality of liquid discharging heads, the head supporter comprising:

a plurality of liquid inlets configured to supply liquid to the plurality of liquid discharging heads, respectively;

a channel system through which coolant flows to control a temperature of the head array unit and including a plurality of coolant channels configured to surround each of the plurality of liquid inlets; and at least two ports connected to each coolant channel of the plurality of coolant channels of the channel system.

3. The head array unit according to claim 1, wherein the plurality of liquid discharging heads is staggered on the head supporter.

4. The head array unit according to claim 2, wherein the plurality of liquid discharging heads is staggered on the head supporter.

5. The head array unit according to claim 2, wherein the plurality of coolant channels of the channel system comprises:

a plurality of main channels configured to extend in a longitudinal direction of the head array unit; and a plurality of sub channels configured to connect the plurality of main channels, wherein at least two sub channels are provided between adjacent liquid discharging heads in the longitudinal direction of the head array unit, and wherein one end of each of the plurality of sub channels intersects one of the plurality of main channels at an acute angle and another end of each of the plurality of sub channels intersects other one of the plurality of main channels at an obtuse angle.

6. The head array unit according to claim 1, wherein a flow direction of the coolant flowing in the channel system is switchable.

7. The head array unit according to claim 2, wherein a flow direction of the coolant flowing in the channel system is switchable.

8. A head array unit, comprising:

a plurality of liquid discharging heads configured to discharge liquid; and a head supporter configured to support the plurality of liquid discharging heads, the head supporter comprising:

a plurality of liquid inlets configured to supply liquid to the plurality of liquid discharging heads, respectively;

a channel system configured to sandwich each of the plurality of liquid inlets and contain coolant flowing in the channel system to control a temperature of the head array unit; and at least two ports connected to the channel system; and temperature sensors provided at least two locations in the head array unit in a longitudinal direction of the head array unit, to detect temperatures at said at least two locations, wherein a flow direction of the coolant flowing in the channel system is switchable, and wherein the flow direction of the coolant is determined based on the detected temperatures of said at least two locations in the head array unit in the longitudinal direction of the head array unit.

9. A head array unit, comprising:

a plurality of liquid discharging heads configured to discharge liquid; and a head supporter configured to support the plurality of liquid discharging heads, the head supporter comprising:

a plurality of liquid inlets configured to supply liquid to the plurality of liquid discharging heads, respectively;

a channel system configured to surround each of the plurality of liquid inlets and contain coolant flowing in the channel system to control a temperature of the head array unit; and at least two ports connected to the channel system, temperature sensors provided at least two locations in the head array unit in a longitudinal direction of the head array unit, to detect temperatures at said at least two locations, wherein a flow direction of the coolant flowing in the channel system is switchable, and wherein the flow direction of the coolant is determined based on the detected temperatures of said at least two locations in the head array unit in the longitudinal direction of the head array unit.

10. The head array unit according to claim 1, wherein a surface area of the channel system increases as the coolant flows in one direction from an upstream toward a downstream of the head supporter so as to increase a heat transmission efficiency.

11. The head array unit according to claim 2, wherein a surface area of the channel system increases as the coolant flows in one direction from an upstream toward a downstream of the head supporter so as to increase a heat transmission efficiency.

12. The head array unit according to claim 1, wherein the coolant is identical with the liquid discharged from the plurality of liquid discharging heads.

13. The head array unit according to claim 2, wherein the coolant is identical with the liquid discharged from the plurality of liquid discharging heads.

14. An image forming apparatus, comprising:

a head array unit, comprising:

a plurality of liquid discharging heads configured to discharge liquid; and a head supporter configured to support the plurality of liquid discharging heads, the head supporter comprising:

a plurality of liquid inlets configured to supply liquid to the plurality of liquid discharging heads, respectively;

a channel system through which coolant flows to control a temperature of the head array unit and including a plurality of coolant channels disposed between the plurality of liquid inlets to sandwich each of the plurality of liquid inlets; and at least two ports connected to each coolant channel of the plurality of coolant channels of the channel system.

15. The head array unit according to claim 1, wherein the head supporter includes a liquid channel and the plurality of coolant channels are provided between the liquid channel and the plurality of liquid discharging heads.

16. The head array unit according to claim 2, wherein the head supporter includes a liquid channel and the plurality of coolant channels are provided between the liquid channel and the plurality of liquid discharging heads.

17. The head array unit according to claim 2, wherein each discharging head of the plurality of liquid discharging heads includes a shared liquid chamber that contains liquid;

wherein the head supporter further includes:

a liquid channel configured to supply liquid to the plurality of liquid discharging heads;

an inlet port disposed at one end of the liquid channel in a longitudinal direction thereof to supply liquid to the liquid channel; and an outlet port disposed at another end of the liquid channel in the longitudinal direction thereof to discharge liquid from the liquid channel; and wherein the plurality of liquid inlets are connected to the liquid channel and the shared liquid chamber of the plurality of liquid discharging heads.

* * * * *